US010131524B2

(12) United States Patent
Wilkins et al.

(10) Patent No.: US 10,131,524 B2
(45) Date of Patent: Nov. 20, 2018

(54) GEAR REDUCTION ASSEMBLY AND WINCH INCLUDING GEAR REDUCTION ASSEMBLY

(71) Applicant: WILKINS IP, LLC, New Albany, IN (US)

(72) Inventors: Stephen P. Wilkins, Floyds Knobs, IN (US); Larry C. Wilkins, Ft. Lauderdale, FL (US)

(73) Assignee: Wilkins IP, LLC, New Albany, IN (US)

( * ) Notice: Subject to any disclaimer, the term of this patent is extended or adjusted under 35 U.S.C. 154(b) by 703 days.

(21) Appl. No.: 14/802,499

(22) Filed: Jul. 17, 2015

(65) Prior Publication Data

US 2015/0321889 A1 Nov. 12, 2015

Related U.S. Application Data

(62) Division of application No. 13/607,078, filed on Sep. 7, 2012, now Pat. No. 9,120,655.

(60) Provisional application No. 61/531,925, filed on Sep. 7, 2011.

(51) Int. Cl.

| | |
|---|---|
| ***B66D 1/22*** | (2006.01) |
| ***B66D 1/04*** | (2006.01) |
| ***B66D 5/00*** | (2006.01) |

(52) U.S. Cl.

CPC ..... *B66D 1/225* (2013.01); *B66D 1/04* (2013.01); *B66D 5/00* (2013.01)

(58) Field of Classification Search

CPC ..... B66D 1/225; B66D 1/04; B66D 5/00

See application file for complete search history.

(56) References Cited

U.S. PATENT DOCUMENTS

| | | | | |
|---|---|---|---|---|
| 253,189 A | | 2/1882 | Davies | |
| 1,272,182 A | | 7/1918 | Appleby | |
| 1,352,653 A | * | 9/1920 | Brown | B66D 1/225 254/356 |
| 1,453,559 A | * | 5/1923 | Webb | B66D 1/225 254/344 |
| 1,609,074 A | * | 11/1926 | Evans | B66D 1/225 254/344 |
| 1,632,571 A | | 6/1927 | Watson | |

(Continued)

OTHER PUBLICATIONS

Internationai Search Report and Written Opinion dated Nov. 26, 2012, in corresponding PCT/US2012/054115.

*Primary Examiner* — Michael E Gallion
(74) *Attorney, Agent, or Firm* — Lee & Hayes, PC

(57) ABSTRACT

A gear reduction assembly may include a main input shaft, a carrier coupled to the main input shaft, and at least one carrier shaft coupled to the carrier and spaced from the main input shaft. The gear reduction assembly may also include at least one spur gear pair including a first spur gear coupled to the carrier shaft, and a second spur gear, wherein the first and second spur gears are coupled to one another such that they rotate together. The gear reduction assembly also includes a first internal gear engaged with the first spur gear, a second internal gear engaged with the second spur gear, and a hub associated with the first internal gear. The first internal gear has a first number of teeth, the second internal gear has a second number of teeth, and the first and second numbers of teeth differ by from one to five teeth.

20 Claims, 18 Drawing Sheets

(56) References Cited

U.S. PATENT DOCUMENTS 2,924,430 A 2/1960 Smith et al.
3,071,349 A 1/1963 Glaze
3,145,974 A 8/1964 Short
3,207,005 A * 9/1965 Geyer ..... F16H 37/00 192/223
3,265,362 A * 8/1966 Moody ..... B66D 1/14 254/343
3,391,583 A 7/1968 Sheesley
3,711,065 A * 1/1973 Lawrence ..... B66D 1/14 192/48.92
3,744,759 A * 7/1973 Jennings ..... B66D 5/00 188/69
3,744,760 A * 7/1973 Uher ..... B66D 1/16 192/12 B
3,799,005 A * 3/1974 Koehler ..... B66D 1/04 254/344
4,004,780 A * 1/1977 Kuzarov ..... B66D 1/16 254/345
4,133,344 A * 1/1979 Hunter ..... A01G 25/092 239/728
4,196,889 A * 4/1980 Dudek ..... B66D 1/22 254/344
4,265,142 A * 5/1981 Watanabe ..... F16H 3/40 242/350
4,426,892 A * 1/1984 Frey ..... F16H 3/721 475/31
4,461,460 A 7/1984 Telford
4,611,787 A * 9/1986 May ..... B66D 1/7415 254/267
4,736,929 A * 4/1988 McMorris ..... B66D 1/22 254/323
5,101,938 A * 4/1992 Eby ..... B66D 1/14 188/180
5,284,325 A * 2/1994 Sasaki ..... B66D 3/22 254/274
5,368,279 A * 11/1994 Ottemann ..... B66D 1/7436 254/342
5,573,091 A * 11/1996 Hung ..... B66D 1/16 192/12 D
6,481,693 B1 11/2002 Tuominen
6,629,905 B1 10/2003 Susselmann et al.
7,000,904 B2 * 2/2006 Huang ..... B66D 1/22 254/323
7,156,585 B2 * 1/2007 Wang ..... F16L 55/30 138/97
7,270,312 B1 * 9/2007 Phipps ..... B66D 1/22 254/278
7,276,009 B2 * 10/2007 Bornchen ..... H02K 7/10 475/149
7,703,751 B2 * 4/2010 Elliott ..... B66D 1/22 254/344
7,731,158 B1 6/2010 Hsieh
7,784,767 B2 8/2010 Gargaro, III et al.
7,789,375 B2 9/2010 Ying
8,434,742 B2 * 5/2013 Akhavein ..... B66D 3/006 254/344
8,808,130 B2 8/2014 Wilkins et al.
9,120,655 B2 * 9/2015 Wilkins ..... B66D 1/225
9,194,460 B2 * 11/2015 Jun ..... F16H 1/36
2002/0151401 A1 10/2002 Lemanski
2008/0078979 A1 * 4/2008 Geagan ..... B66D 1/04 254/267
2009/0114892 A1 * 5/2009 Lesko ..... B66D 1/22 254/342
2010/0065799 A1 * 3/2010 Zhou ..... B66D 1/22 254/344
2010/0085799 A1 3/2010 Zhou et al.
2010/0133372 A1 * 6/2010 Ying ..... B66D 1/04 242/395
2011/0147684 A1 * 6/2011 Roodenburg ..... B66D 1/225 254/297
2011/0180770 A1 * 7/2011 Karambelas ..... B66D 1/12 254/344
2011/0272653 A1 * 11/2011 Cilliers ..... B66D 1/08 254/334
2012/0055743 A1 * 3/2012 Jun ..... B66B 7/10 187/412
2012/0065018 A1 * 3/2012 Wilkins ..... F16H 1/32 475/162
2013/0056694 A1 * 3/2013 Wilkins ..... B66D 1/225 254/342
2013/0337965 A1 12/2013 Kuo

* cited by examiner

SECTION A–A

SECTION C-C

SECTION A–A

GEAR REDUCTION ASSEMBLY AND WINCH INCLUDING GEAR REDUCTION ASSEMBLY

RELATED APPLICATION

This application is a divisional and claims the benefit of U.S. patent application Ser. No 13/607,078 , filed Sep. 7, 2012, which claims the benefit of priority under 35 U.S.C. § 119(e) of U.S. Provisional Application No. 61/531,925, filed Sep. 7, 2011, the disclosures of both of which are incorporated herein by reference.

FIELD OF THE DISCLOSURE

The present disclosure relates to gear reduction assemblies, and more particularly, to gear reduction assemblies for winches and winches including gear reduction assemblies.

BACKGROUND

Gear reduction assemblies are often used to facilitate to the use of a less powerful input force or prime mover to perform tasks on high loads. Gear reduction assemblies may also reduce output speed based on the input of a prime mover having an undesirably high output speed.

An example of an application where a gear reduction assembly may be desirable is a winch. For example, winches are often used to deploy or retract a line, such as cable, against a heavy load. Such winches may be hand-operated or motor-driven. Winches may be used when transporting solid and/or liquid cargo via barges along bodies of water. With an increase in a desire to transport cargo more efficiently and with less undesirable emissions, the use of barges to transport cargo has become increasingly attractive. For example, recent studies indicate that transport of cargo by barge is more than 25% more efficient than transport by rail and more than three times as efficient as transport by truck. In addition, transport of cargo by barge results in significantly less undesirable emissions than transport by rail and truck.

In order to increase the efficiency of transport of cargo via barges, a number of barges may be grouped together in a barge "train" or "tow" by cables and pushed or pulled by a single or several boats. For example, as many as forty barges may be held together in a group of five rows by eight rows.

In such barge "trains" or "tows," it may be desirable to adjust the tension and/or length of the cables holding the barges together to facilitate control of the barges during the release or addition of barges with respect to the group, or during navigation of a waterway. A common device for facilitating such adjustments is a hand-operated hoist sometimes referred to as a "come-a-long." However, hand-operated hoists, while very portable, suffer from a number of possible drawbacks, such as physically-demanding operation and a tendency to become misplaced.

An alternative to hand-operated hoists is winches, which may be either hand-operated or motor-driven. However, conventional winches may suffer from a number of possible drawbacks. For example, many winches have a drum around which the line or cable is wrapped. However, the diameter of the drum may be relatively small in order to permit use of a relatively small motor or render it easier to reel up the line by hand. This may lead to a number of possible drawbacks related to the line being tightly wrapped around the relatively small drum, such as, for example, creating kinks or deformations in the line, which may have memory due to the large diameter of the line. This may promote problems with the use of such a winch under certain circumstances.

Moreover, some conventional winches rely on a locking ratchet gear to hold a load resulting from the tightening of a cable by the winch. Although a ratchet gear may be effective for holding a load, a ratchet gear is inherently either fully engaged or fully disengaged, and thus, when a load held by a ratchet gear is released, the operator of the winch has no control of the rate of release of the load. Such an uncontrolled release of a large load is potentially dangerous to the operator.

Thus, it may be desirable to provide a gear reduction assembly that provides a relatively dramatic gear reduction in a relatively compact manner. Further, it may be desirable to provide a winch that has a relatively large diameter drum that may be driven with relatively less effort via hand and/or relatively less power via a motor. It may also be desirable to provide a winch that facilitates a controlled release of a large load, for example, at a controlled rate.

SUMMARY

In the following description, certain aspects and embodiments will become evident. It should be understood that the aspects and embodiments, in their broadest sense, could be practiced without having one or more features of these aspects and embodiments. It should be understood that these aspects and embodiments are merely exemplary.

One aspect of the disclosure relates to a gear reduction assembly. The gear reduction assembly includes a main input shaft, a carrier coupled to the main input shaft, and at least one carrier shaft coupled to the carrier and spaced from the main input shaft. The gear reduction assembly also includes at least one spur gear pair including a first spur gear coupled to the carrier shaft, and a second spur gear, wherein the first spur gear and the second spur gear are coupled to one another such that the first and second spur gears rotate together. The gear reduction assembly also includes a first internal gear engaged with the first spur gear, a second internal gear engaged with the second spur gear, and a hub associated with the first internal gear. The first internal gear has a first number of teeth, the second internal gear has a second number of teeth, and the first number of teeth differs from the second number of teeth by from one to five teeth.

According to another aspect, a gear reduction assembly includes a main input shaft, a carrier coupled to the main input shaft, and at least one carrier shaft coupled to the carrier and spaced from the main input shaft. The gear reduction assembly further includes at least one spur gear pair including a first spur gear coupled to the carrier shaft, and a second spur gear, wherein the first spur gear and the second spur gear are coupled to one another such that the first and second spur gears rotate together. The gear reduction assembly also includes a first internal gear engaged with the first spur gear, a second internal gear engaged with the second spur gear, and a hub associated with the first internal gear. The first internal gear has a first number of teeth, the second internal gear has a second number of teeth, and the first number of teeth differs from the second number of teeth by from one to five teeth. The first internal gear has a first diameter and the second internal gear has a second diameter, and the first diameter of the first internal gear differs from the second diameter of the second internal gear.

According to still a further aspect, a gear reduction assembly includes a main input shaft, a carrier coupled to the main input shaft, and at least one carrier shaft coupled to the carrier and spaced from the main input shaft. The gear reduction assembly further includes at least one spur gear pair including a first spur gear coupled to the carrier shaft, and a second spur gear, wherein the first spur gear and the second spur gear are coupled to one another such that the first and second spur gears rotate together. The gear reduction assembly also includes a first internal gear engaged with the first spur gear, a second internal gear engaged with the second spur gear, and a hub associated with the first internal gear. The first spur gear and the second spur gear have the same number of teeth. The first internal gear has a first number of teeth, the second internal gear has a second number of teeth, and the first number of teeth differs from the second number of teeth by from one to five teeth.

According to yet another aspect, a gear reduction assembly includes a main input shaft, a carrier coupled to the main input shaft, and at least one carrier shaft coupled to the carrier and spaced from the main input shaft. The gear reduction assembly further includes at least one spur gear pair including a first spur gear coupled to the carrier shaft, and a second spur gear, wherein the first spur gear and the second spur gear are coupled to one another such that the first and second spur gears rotate together. The gear reduction assembly also includes a first internal gear engaged with the first spur gear, a second internal gear engaged with the second spur gear, and a hub associated with the first internal gear. The first internal gear has a first number of teeth, and the second internal gear has a second number of teeth. One of the first and second number of teeth of the first and second internal gears is greater, and wherein a ratio of a rotation speed of the main input shaft to a rotation speed of the first internal gear equals the greater of the first number of teeth and the second number of teeth, divided by the difference between the first number of teeth of the first internal gear and the second number of teeth of the second internal gear.

According to still another aspect, a winch for at least one of deploying line and retracting line includes a base member, two side members coupled to the base member, and a hub about which line may be wound. The winch further includes a gear reduction assembly including a main input shaft, a carrier coupled to the main input shaft, and at least one carrier shaft coupled to the carrier and spaced from the main input shaft. The gear reduction assembly further includes at least one spur gear pair including a first spur gear coupled to the carrier shaft, and a second spur gear, wherein the first spur gear and the second spur gear are coupled to one another such that the first and second spur gears rotate together. The gear reduction assembly further includes a first internal gear engaged with the first spur gear, and a second internal gear engaged with the second spur gear, wherein the first internal gear and the hub are coupled to one another. The second internal gear and one of the side members are coupled to one another, and rotation of the main input shaft results in rotation of the hub.

It is to be understood that both the foregoing general description and the following detailed description are exemplary and explanatory only and are not restrictive of the invention. The accompanying drawings, which are incorporated in and constitute a part of this specification, illustrate several exemplary embodiments and together with the description, serve to outline principles of the exemplary embodiments.

DESCRIPTION OF EXEMPLARY EMBODIMENTS

Reference will now be made in detail to exemplary embodiments illustrated in the accompanying drawings. Wherever possible, the same reference numbers will be used throughout the drawings to refer to the same or like parts.

Figure 1:
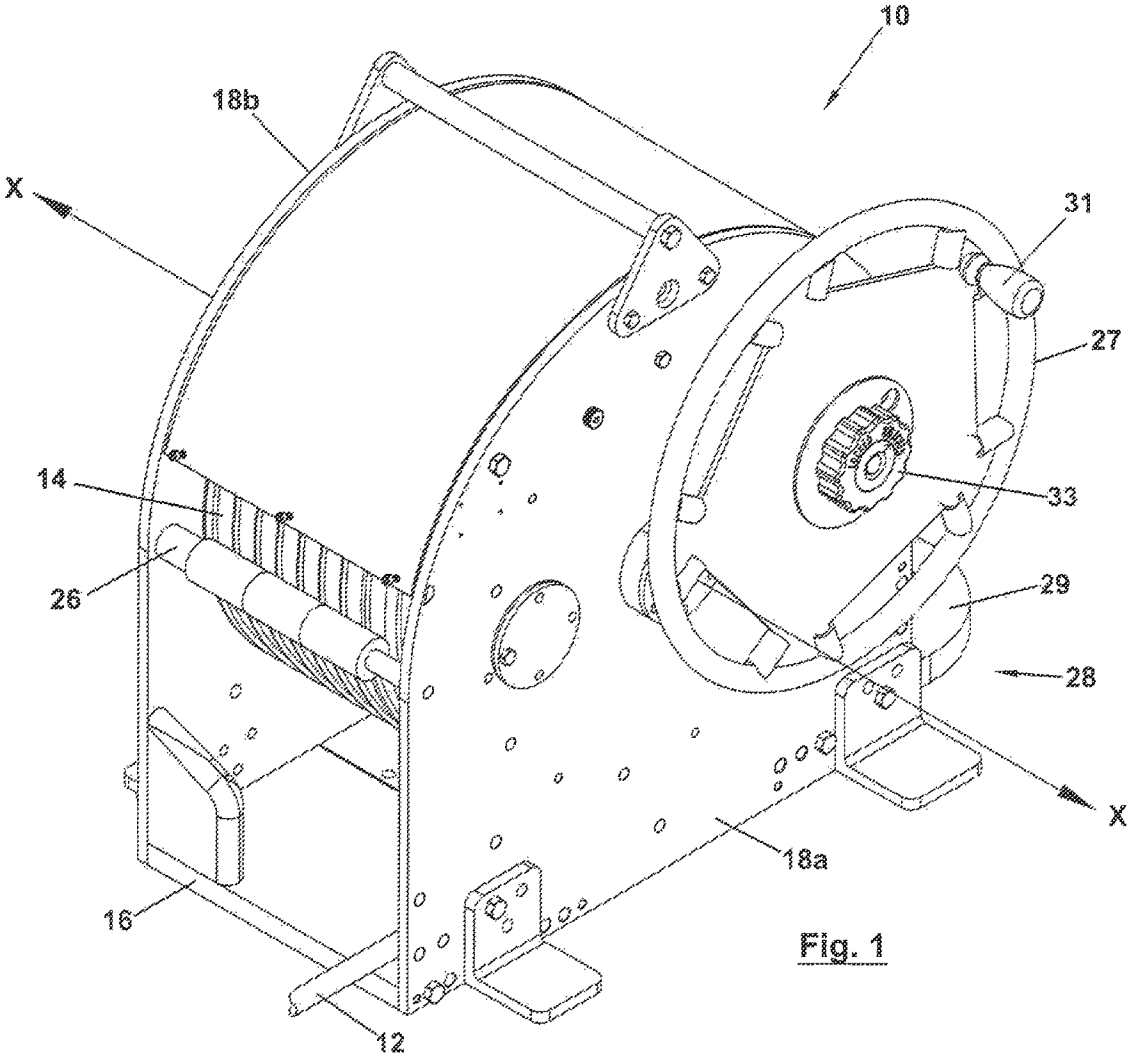
FIG. 1 is a perspective view of an exemplary embodiment of a winch.
Figure 2:
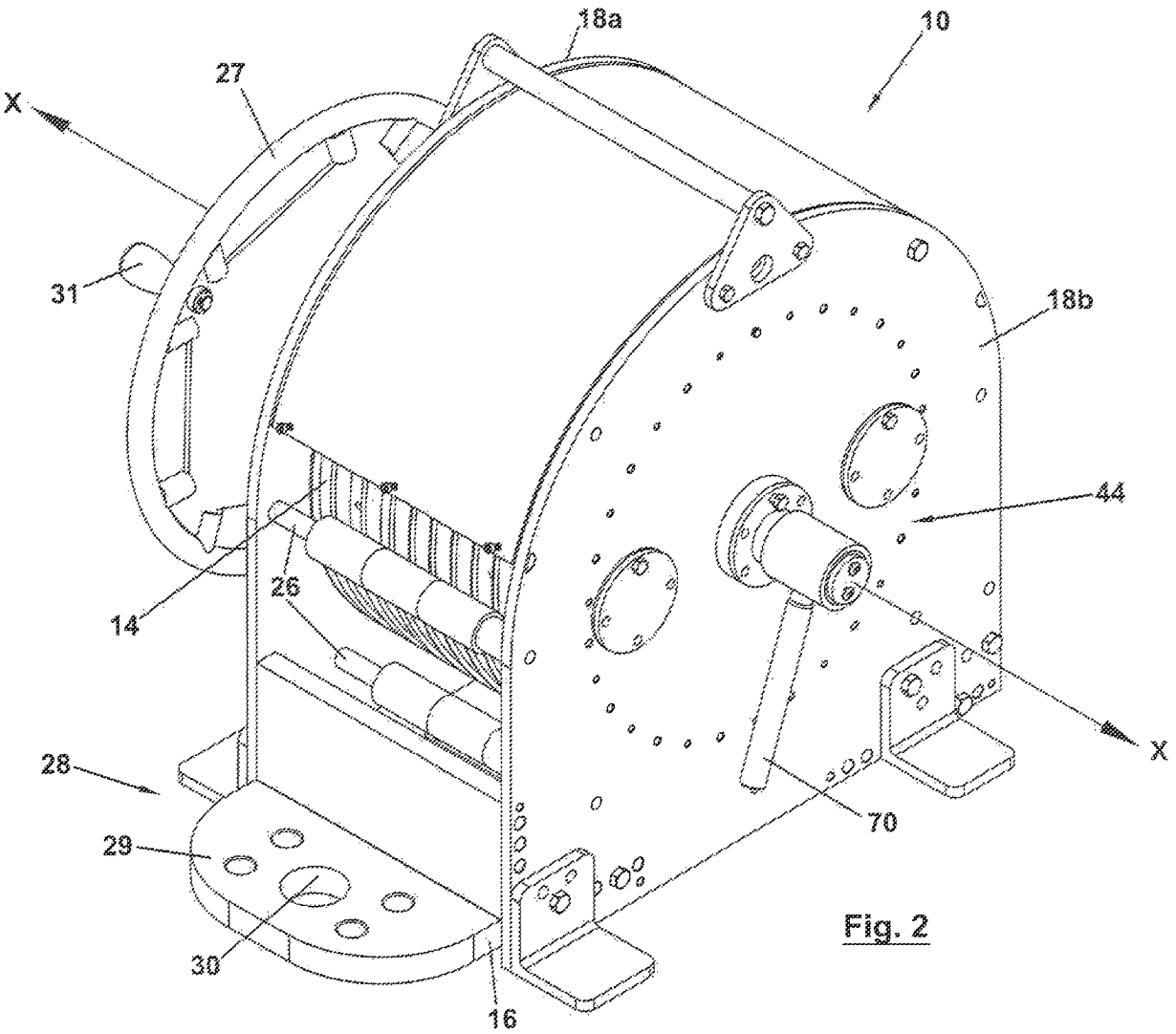
FIG. 2 is a perspective view of the exemplary embodiment shown in FIG. 1 from a reverse side.

FIGS. 1 and 2 show an exemplary embodiment of a winch 10. Exemplary winch 10 may be used in a conventional manner to perform a number of tasks related to deploying or paying-out line attached to a load, pulling against a line attached to a load, and/or merely maintaining a tension in the line attached to a load. For example, winch 10 may have a hub 14 about which a cable 12 may be wound, such as exemplary drum shown in FIG. 1. Exemplary winch 10 may be used in association with barges (not shown) for transport of solid and/or liquid goods on waterways. In particular, winch 10 may be used to adjust the tension and/or length of a cable extending between two or more barges grouped together in a barge "train" or "tow." Such adjustment may facilitate control of the barges during the release or addition of barges with respect to the group, or during navigation of a waterway. Other uses for exemplary winch 10 are contemplated.

Although exemplary hub 14 shown in FIGS. 1 and 2 is a drum for exemplary winch 10, hub 14 may serve as other output devices associated with other machines. For example, hub 14 may serve as a drum for a winch or a spindle adapted to be used on a vehicle, such as, a tow truck, rescue vehicle, or off-road vehicle. In addition, hub 14 may serve as a drum for a winch of a crane.

Exemplary winch 10 shown in FIGS. 1 and 2 includes a base member 16 and two opposing side members 18*a* and 18*b*. Exemplary hub 14 is substantially cylindrical, having a circular cross-sectional shape with a longitudinal axis X extending through the center of the circular cross-section. Hub 14 is positioned between opposing side members 18*a* and 18*b* such that longitudinal axis X is substantially perpendicular to opposing side members 18*a* and 18*b*. As explained in more detail herein, exemplary hub 14 is supported in a rotating manner by a main input shaft 20, which extends through apertures 22*a* and 22*b* of respective opposing sides 18*a* and 18*b* (see FIGS. 3-6). Main input shaft 20, in turn, is supported by bearings 24*a* and 24*b* received in respective apertures 22*a* and 22*b*. Side members 18*a* and 18*b* may be held together in a spaced manner by one or more cross-members 26, which in the exemplary embodiment shown, extend between side members 18*a* and 18*b* in a substantially perpendicular manner.

Arranged in this exemplary manner, main input shaft 20 may be driven by hand operation via, for example, a crank 27, and/or by a motor (not shown), such as, for example, an electric motor, or an engine, such as, for example, an internal combustion engine, or a combination thereof. For example, as shown in FIG. 1, crank 27 may include a handle 31 for facilitating faster rotation of crank 27. According to some embodiments, winch 10 may include a handle lock mechanism 33 for preventing crank 27 from being accidentally rotated. During operation, as main input shaft 20 is driven rotationally, hub 14 rotates, thereby deploying or paying-out, and/or retracting a line, such as cable 12, as it is unwound or wound-up around hub 14.

According to some embodiments, exemplary winch 10 may be capable of acting against loads of as much as, for example, 25 tons to 75 tons, for example, 40 tons, or more. Some embodiments may be used in combination with motors and/or engines having, for example, 5 horsepower to 25 horsepower or more. Some embodiments of exemplary winch 10 may be capable of being used with line, such as cable (or wire-rope), having a diameter of between about, for example, 0.25 inch to 1.50 inches, for example, 1.0 inch. Hub 14 may be between about, for example, 6 inches and 90 inches long, for example, 6 inches to 12 inches long, in the direction of the longitudinal axis X. Hub 14 may have a diameter based on the circular cross-sectional shape between about, for example, 6 inches and 90 inches, for example, 18 inches. Other capabilities and/or dimensions are contemplated.

Figure 3:
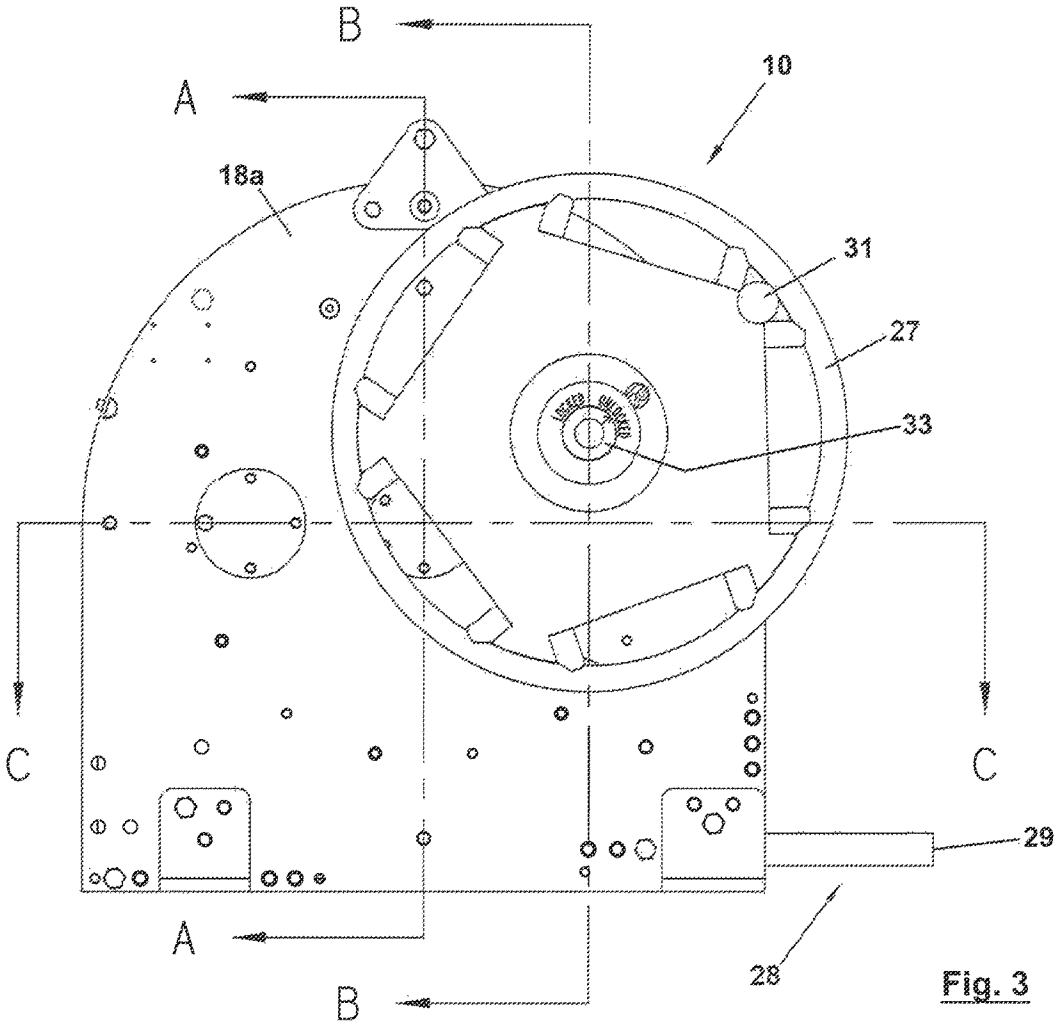
FIG. 3 is a side view of the exemplary embodiment shown in FIGS. 1 and 2.

As shown in FIGS. 2 and 3, exemplary base member 16 includes an anchor 28 formed by an extension 29 of base member 16. Exemplary anchor 28 includes one or more apertures 30. Anchor 28 may be used to couple exemplary winch 10 to a support. For example, winch 10 may be placed on a barge (not shown) and, for example, a post, stud, or bolt may extend through aperture 30, thereby holding winch 10 in a fixed position relative to the supporting structure. Other anchor structures are contemplated, such as anchor structures having multiple apertures, structures anchored to the supporting structure by fixed means (e.g., welding), etc.

Figure 7:
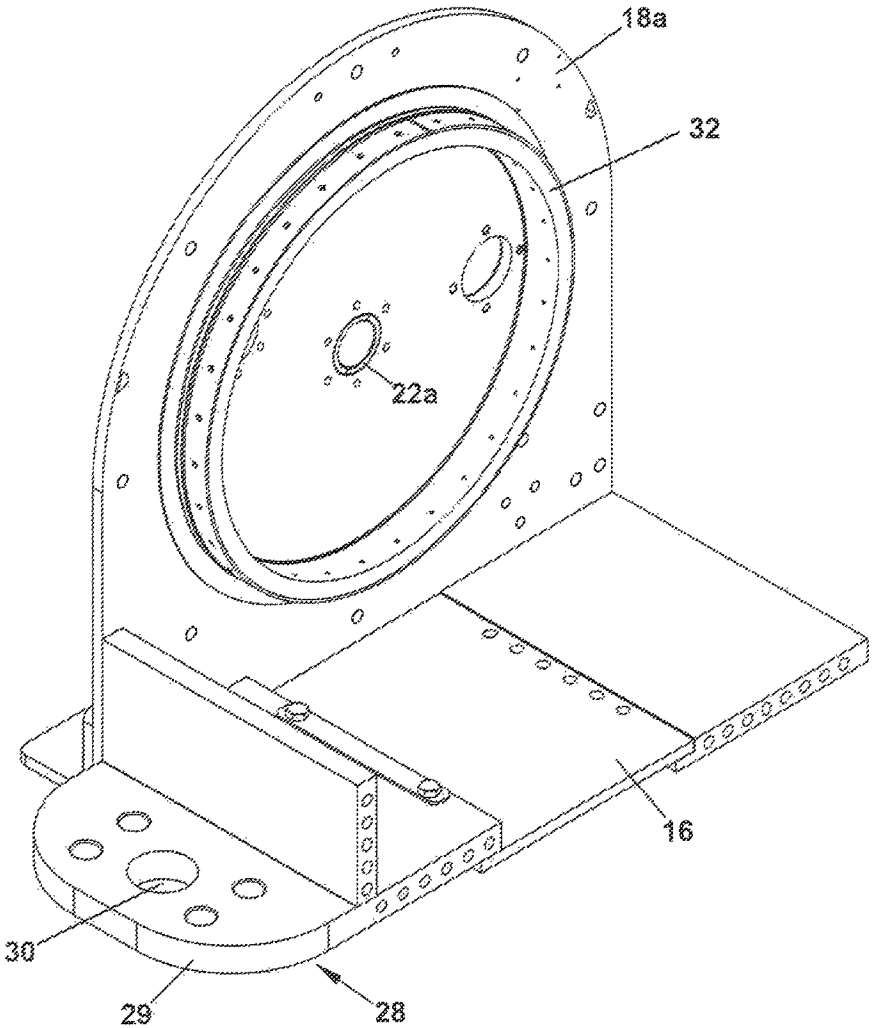
FIG. 7 is a perspective view of a portion of the exemplary embodiment shown in FIG. 1.
Figure 8:
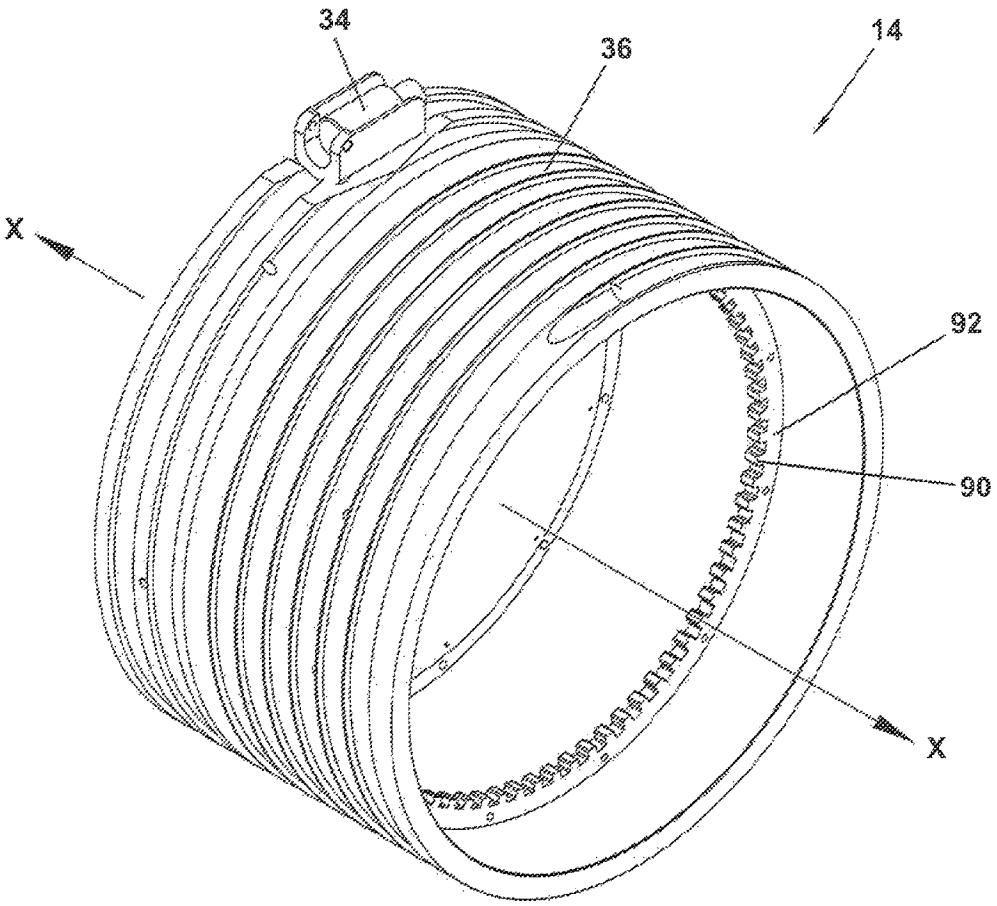
FIG. 8 is a perspective view of an exemplary embodiment of a hub and associated parts.
Figure 9:
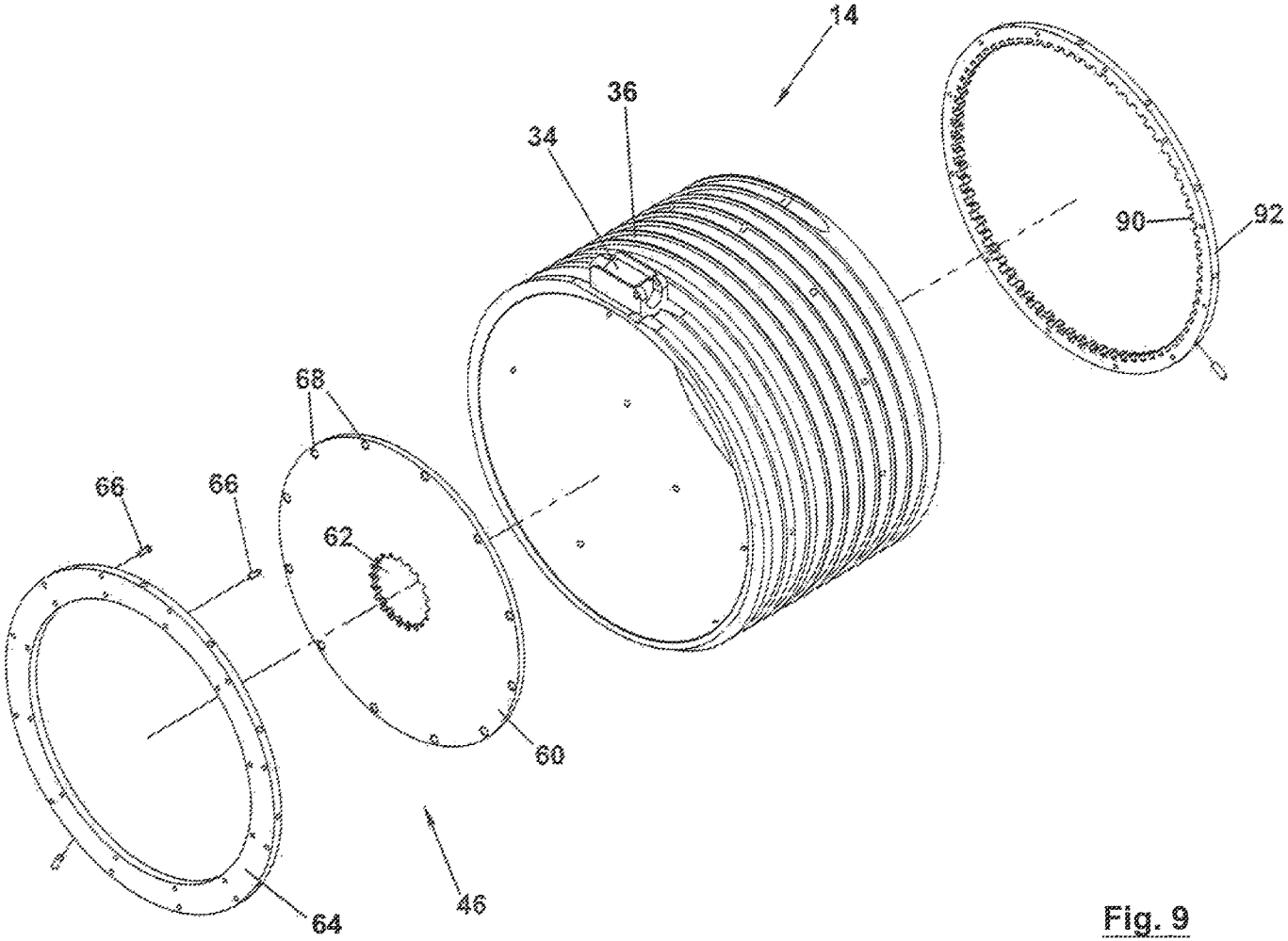
FIG. 9 is a perspective exploded view of the exemplary hub shown in FIG. 8.

Opposing side members 18*a* and 18*b* may be secured to base member 16 such that they extend from base member 16 in a substantially perpendicular manner, as shown in FIGS. 1 and 2. For example, side members 18*a* and/or 18*b* may be coupled to base member 16 via welding, adhesives, and/or fasteners, such as, for example, bolts and rivets. Alternatively, base member 16 may be formed integrally with one or more of side members 18*a* and 18*b* via, for example, extrusion, casting, or forging. As shown in FIG. 7, a hub guide ring 32 may be provided on an inner surface of side member 18*a*. Hub guide ring 32 provides a support and guide for hub 14 adjacent side member 18*a*. During operation, an inner surface of hub 14 rotates about hub guide ring 32.

As shown in FIGS. 8-10C, exemplary hub 14 is substantially hollow, including a tubular member extending substantially between opposing side members 18*a* and 18*b*. Although the exemplary tubular member of hub 14 has a circular-shaped cross-section, the tubular member may have other cross-sectional shapes, such as, for example, multi-sided shapes such as octagonal, hexagonal, pentagonal, and square-shaped.

According to some embodiments, winch 10 may be configured such that a line, such as cable 12, wound around hub 14 may not exceed a single layer of cable windings. For example, for a known length of cable 12 having a known diameter, hub 14 may have a circumference and longitudinal length between the opposing ends of hub 14 sufficient to permit all of a desired length of cable to be stored on hub 14, without any of the cable 12 overlapping itself. This may be desirable to promote reliable deployment and/or retraction of cable 12 by winch 10. For example, exemplary hub 14 shown in FIGS. 8-10A includes a line anchor 34 configured to couple line 12 to the outer surface of hub 14. According to some embodiments, the outer surface of hub 14 includes a line guide groove 36 configured to provide a substantially semi-circular recess for receiving line 12. Exemplary line guide groove 36 forms a helix on the outer surface of hub 14 extending from one end of hub 14 at line anchor 34 to the other end of hub 14 that receives line 12. This configuration promotes an even distribution of line 12 on the outer surface of hub 14 as line 12 is retracted and deployed.

Figure 4:
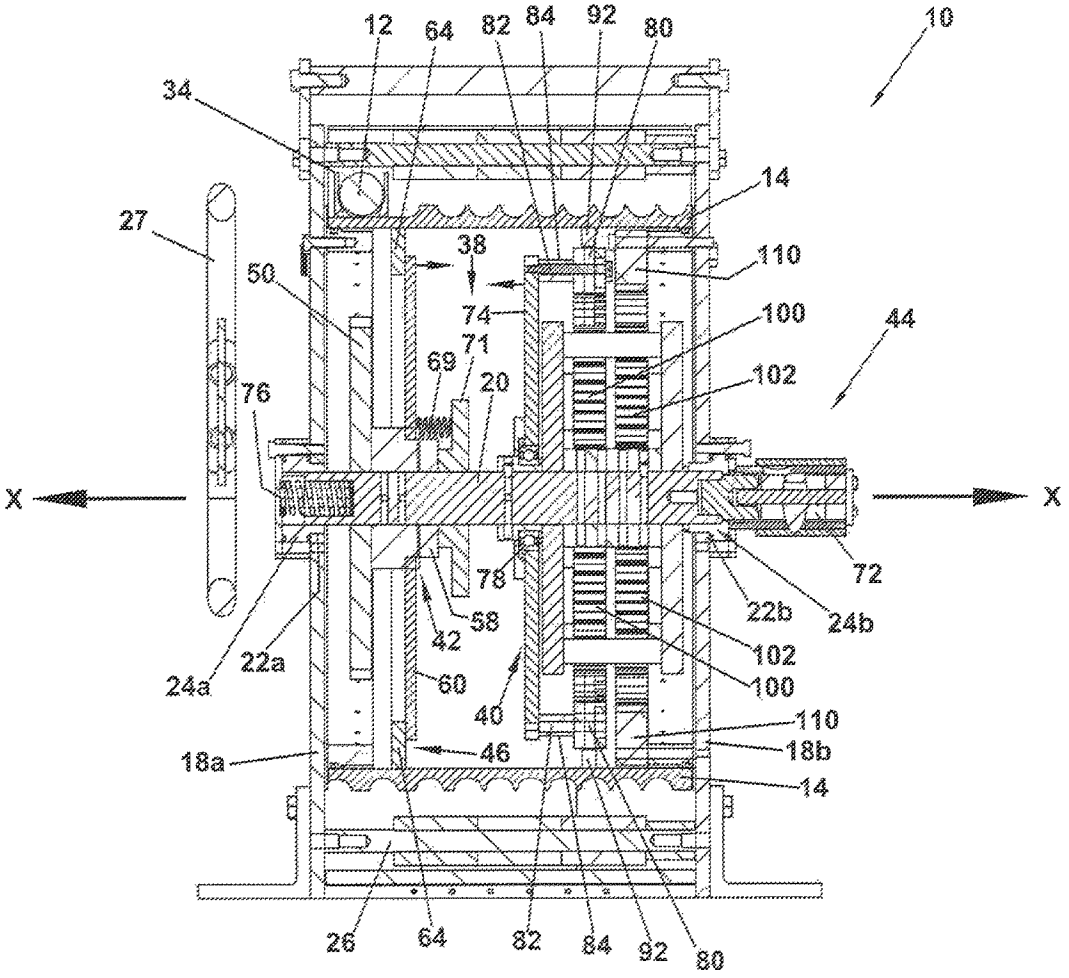
FIG. 4 is an end section view taken along line A-A of FIG. 3.
Figure 5:
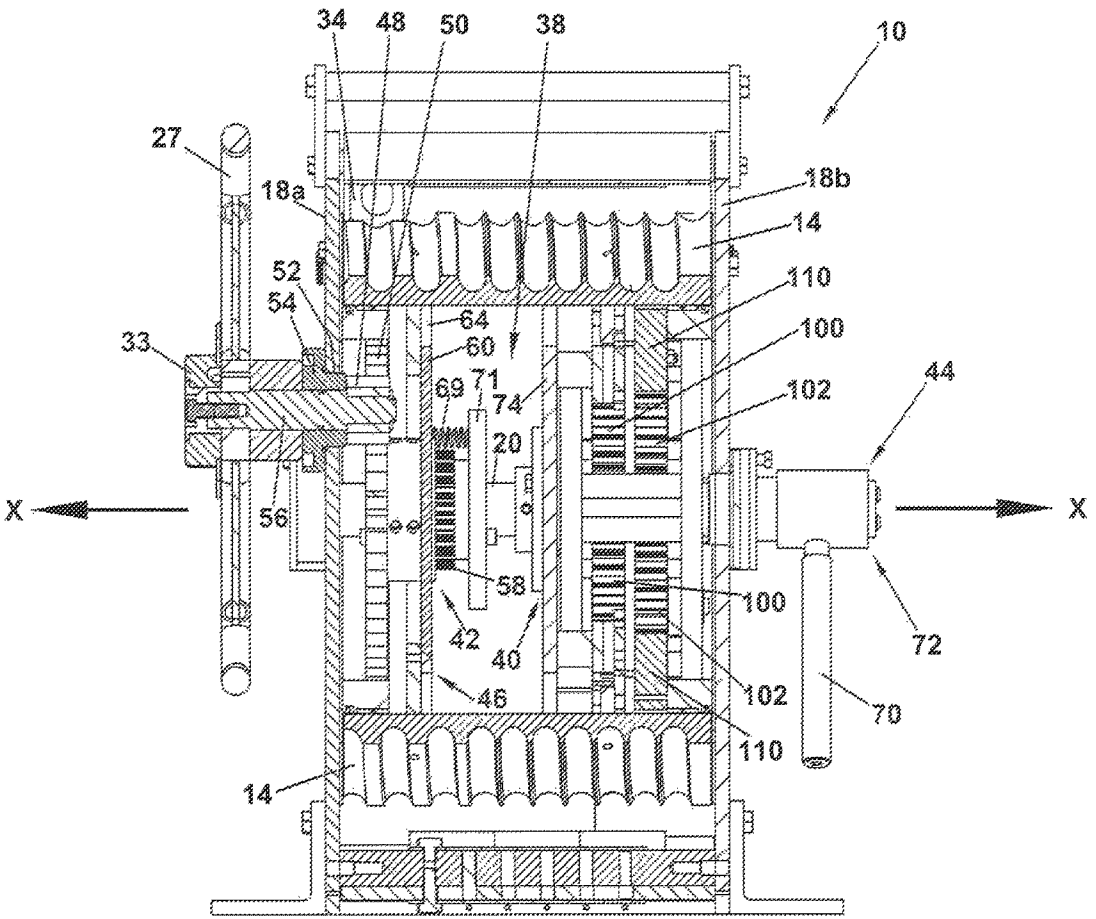
FIG. 5 is an end section view taken along line B-B of FIG. 3.
Figure 6:
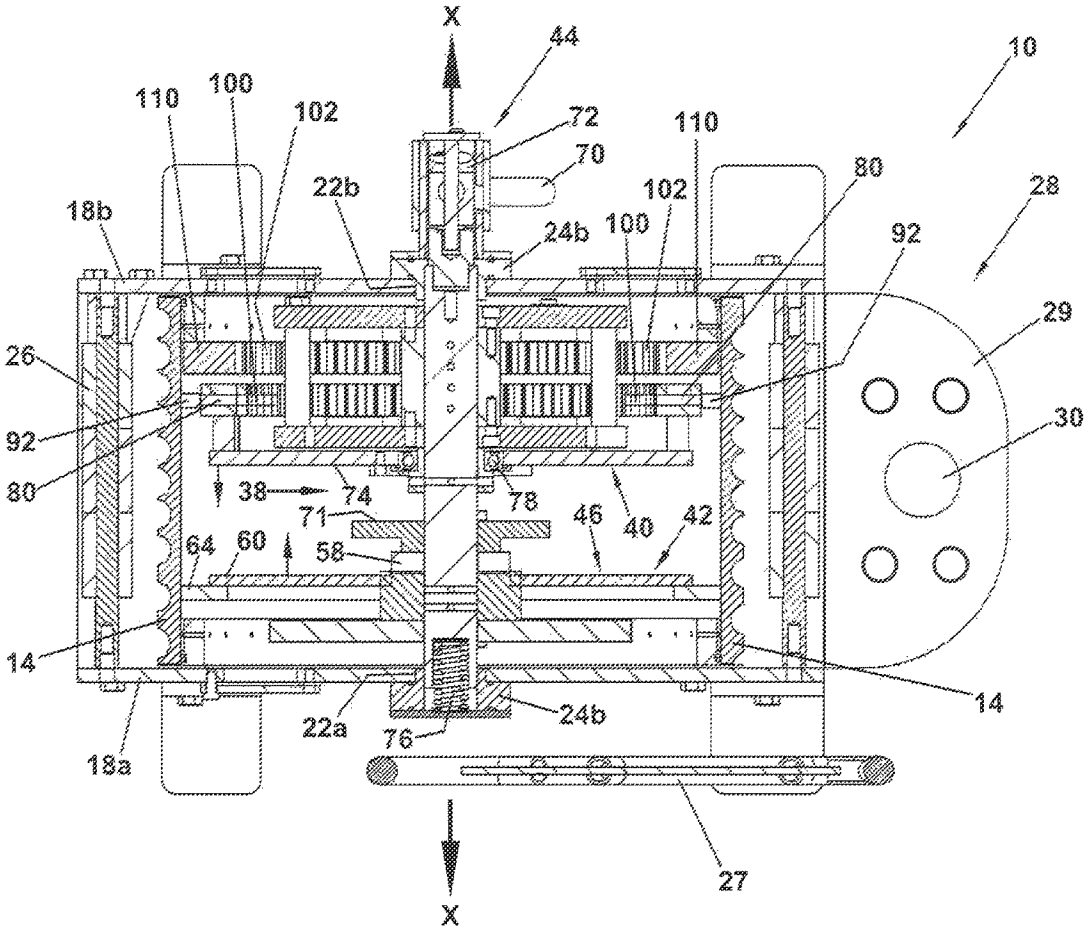
FIG. 6 is a top section view taken along line C-C of FIG. 3.

As shown in FIGS. 4-6, exemplary winch 10 includes a gear reduction assembly 38 configured to transfer torque from crank 27 to hub 14. For example, as shown in FIG. 5, gear reduction assembly 38 includes a primary gear reduction assembly 40 and a secondary gear reduction assembly 42. According to some embodiments, gear reduction assembly 38 may be selectively shifted between use of both primary gear reduction assembly 40 and secondary gear reduction assembly 42, which provides a maximum gear reduction, and use of only secondary gear reduction assembly 42, which provides a minimum gear reduction. The maximum gear reduction may be used for transferring torque to high loads, for example, to reel in a barge coupled to line 12 associated winch 10, and the minimum gear reduction may be used for transferring torque to relatively lower loads, for example, to reel in line 12 more quickly when line 12 is not coupled to a high load.

As shown in FIGS. 4 and 6, some embodiments may include a shift mechanism 44 configured to selectively couple and un-couple primary gear reduction assembly 40 from hub 14, so that winch 10 can be switched between use of primary and secondary gear reduction assemblies 40 and 42, and use of only secondary gear reduction assembly 42. In particular, in a first setting of shift mechanism 44, crank 27 is coupled to secondary gear reduction assembly 42, which transfers torque from crank 27 to main input shaft 20, and main input shaft 20 transfers torque to primary gear reduction assembly 40, which in turn, transfers torque to hub 14, thereby providing the maximum gear reduction between crank 27 and hub 14. In a second setting of shift mechanism 44, primary gear reduction mechanism 40 is disengaged from hub 14 such that torque is transferred from secondary gear reduction assembly 42 to main input shaft 20 through a torque transfer assembly 46 to hub 14, thereby bypassing primary gear reduction assembly 40.

Figure 12B:
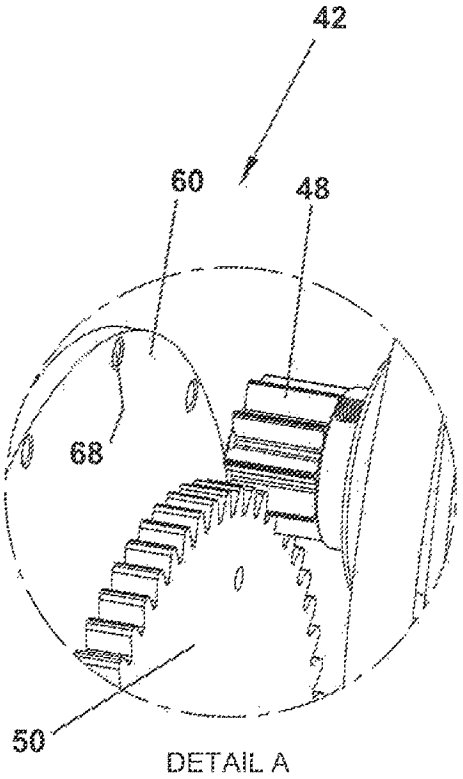
FIG. 12B is a detail view shown at A in FIG. 12A.
Figure 12A:
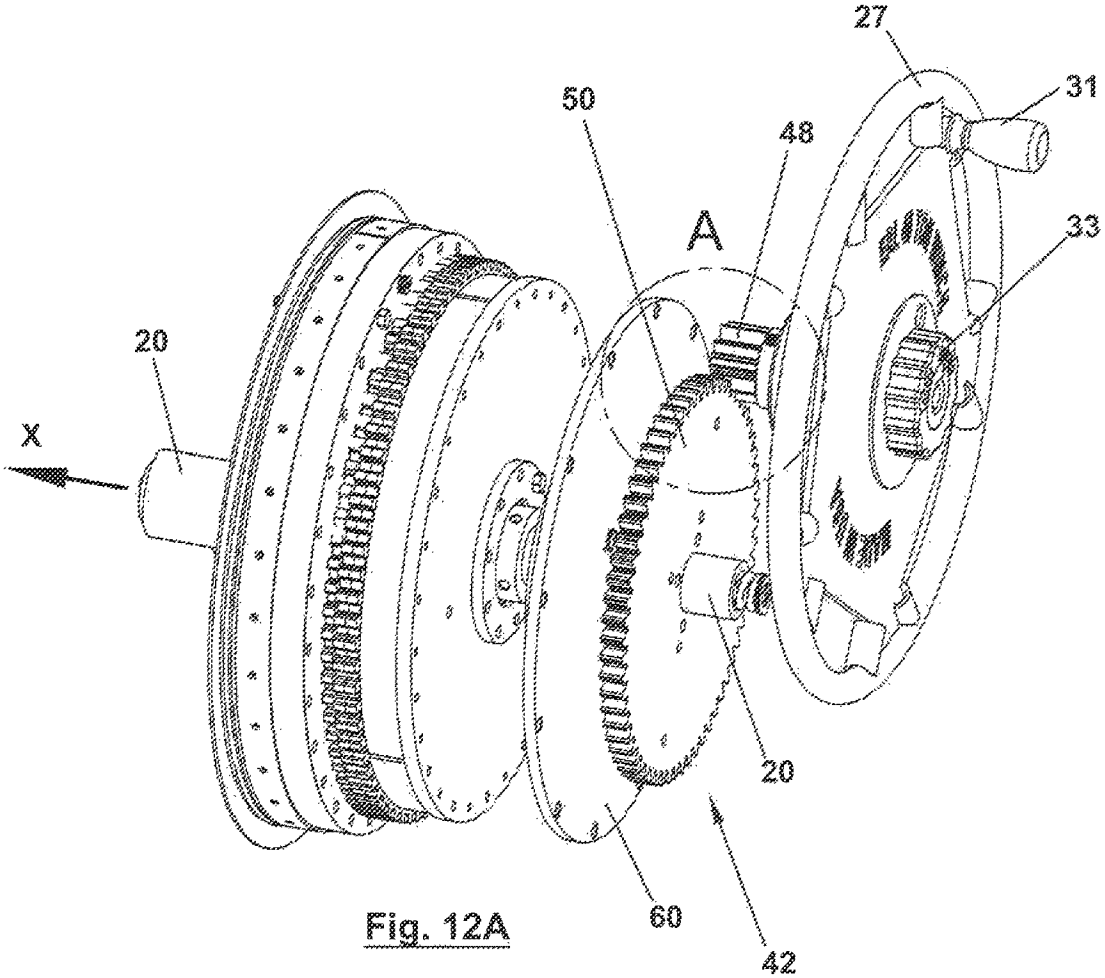
FIG. 12A is a partial perspective view of a portion of the exemplary embodiment shown in FIG. 1.

Referring to FIGS. 12A and 12B, exemplary secondary gear reduction assembly 42 includes a drive gear 48 engaged with a driven gear 50. In the exemplary embodiment shown, side member 18*a* includes an aperture 52 provided with a bearing 54 (see FIG. 5). Crank 27 is coupled to drive gear 48 via a secondary shaft 56, which extends through bearing 54, such that crank 27 and drive gear 48 are located on opposite sides of side member 18*a*. Driven gear 50 is mounted on main input shaft 20 such that rotation of driven gear 50 results in rotation of main input shaft 20. During exemplary operation, as crank 27 is rotated, secondary shaft 56 is rotated, which results in drive gear 48 rotating. Drive gear 48 is engaged with driven gear 50, resulting in driven gear 50 being rotated, which in turn, results in main input shaft 20 rotating. According to some embodiments, drive gear 48 may range from 5 to 15 teeth (e.g., 10 teeth), and driven gear may range from 50 teeth to 80 teeth (e.g., 64 teeth), resulting in a ratio of input at crank 27 to output at driven gear 50 of about 6:1, or when secondary gear reduction assembly 42 is coupled to hub 14 via torque transfer assembly 46, a ratio of input at crank 27 to output at hub 14 of 6:1.

Figure 10C:
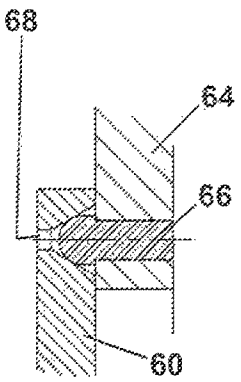
FIG. 10C is a detail section view shown at B in FIG. 10B.
Figure 10B:
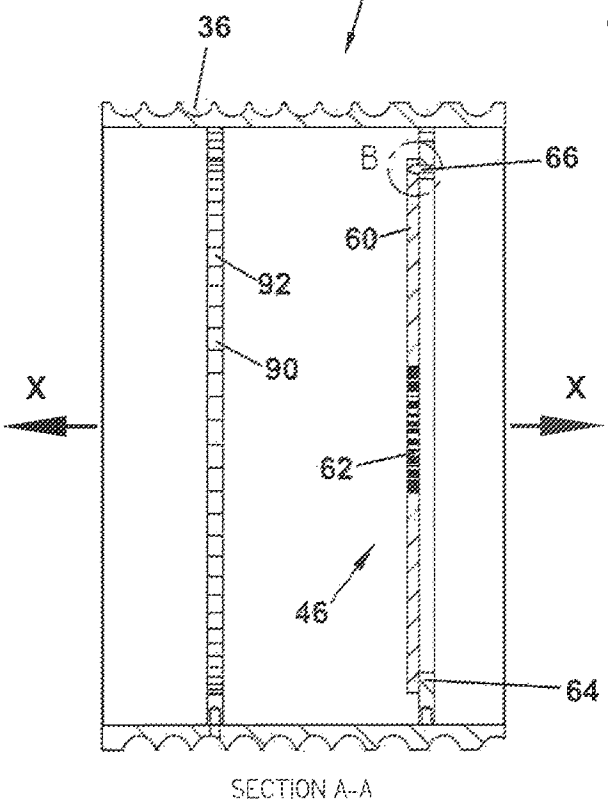
FIG. 10B is an end section view taken along line A-A of FIG. 10A.
Figure 10A:
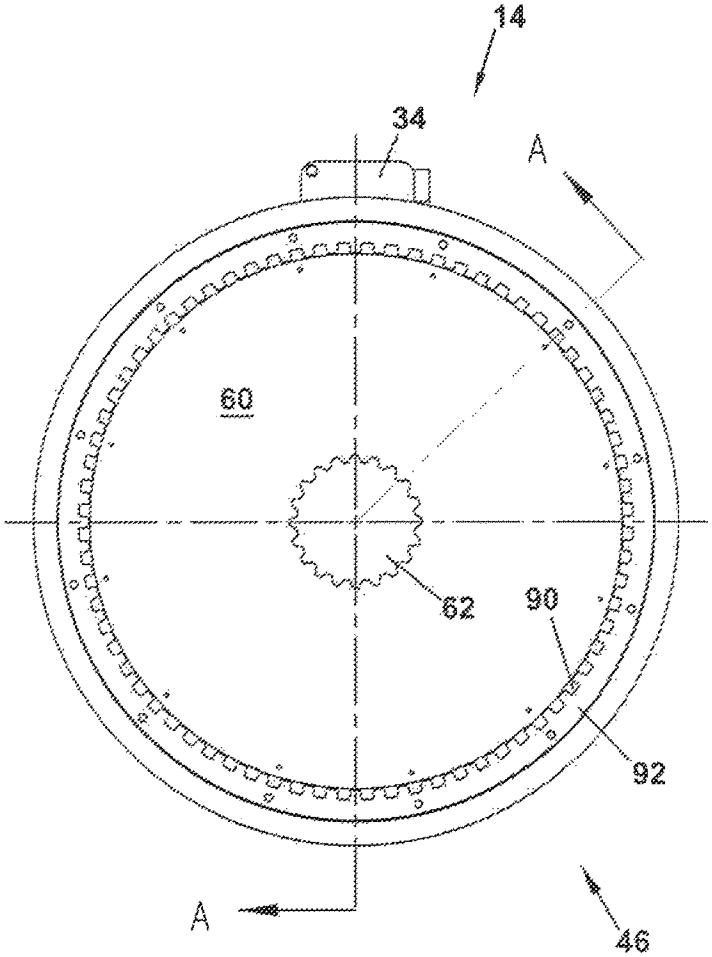
FIG. 10A is a side view of the exemplary hub and associated parts shown in FIG. 8.

As noted above, secondary gear reduction assembly 42 may be selectively coupled directly to hub 14 via torque transfer assembly 46. As shown in FIGS. 4-6 and 9-11, exemplary torque transfer assembly 46 includes a transfer gear 58 coupled to main input shaft 20, such that as main input shaft 20 rotates, transfer gear 58 rotates. Exemplary torque transfer assembly 46 also includes a clutch plate 60 engaged with transfer gear 58. For example, as shown in FIGS. 9 and 10A-10C, exemplary clutch plate 60 includes an internal gear 62 engaged with transfer gear 58. Exemplary torque transfer assembly 46 also includes a clutch ring 64 coupled to the inner surface of hub 14, as shown in FIG. 10B. Exemplary clutch ring 64 includes a plurality of clutch pins 66 (see FIGS. 10B and 10C), and clutch plate 60 includes a plurality of recesses or apertures 68, each configured to receive one of the plurality of clutch pins 66.

As shown in FIGS. 4-6, shift mechanism 44 is in a position resulting in clutch plate 60 being disengaged from clutch 64. In this mode of operation, secondary gear reduction assembly 42 is coupled to main input shaft 20, but main input shaft 20 is not coupled to hub 14 via torque transfer assembly 46 because clutch pins 66 are not engaged with recesses or apertures 68 of clutch plate 60. However, as explained in more detail below, as shift mechanism 44 is operated such that clutch plate 60 moves into engagement with clutch pins 66 (i.e., clutch plate 60 moves to the left as shown in FIG. 4), torque transfer assembly 46 couples main input shaft 20 to hub 14, such that main input shaft 20 drives hub 14 via transfer gear 58, clutch plate 60, clutch pins 66, and clutch ring 64. In particular, recesses or apertures 68 of clutch plate 60 receive clutch pins 66, such that clutch plate 60 drives clutch ring 64, which in turn, drives hub 14. However, as explained in more detail below, as shift mechanism 44 is operated such that clutch plate 60 is moved out of engagement with clutch pins 66 (i.e., clutch plate 60 is moved to the right as shown in FIG. 4), torque transfer assembly 46 becomes disengaged from hub 14. As explained in more detail below, as torque transfer assembly 46 is disengaged from hub 46, primary gear reduction assembly 40 becomes engaged with hub 14.

According to some embodiments, clutch pins 66 are configured such that only a limited amount of torque can be applied to hub 14 via torque transfer assembly 46. In particular, if too much torque is applied to torque transfer assembly, clutch pins 66 will become disengaged with recesses or apertures 68 of clutch plate 60, such that torque is not transferred between clutch plate 60 and clutch ring 64 until the torque is reduced to the point at which clutch pins 66 become re-engaged with recesses or apertures 68. This exemplary configuration may prevent damage to other parts of gear reduction assembly 38 and/or winch 10.

Figure 11:
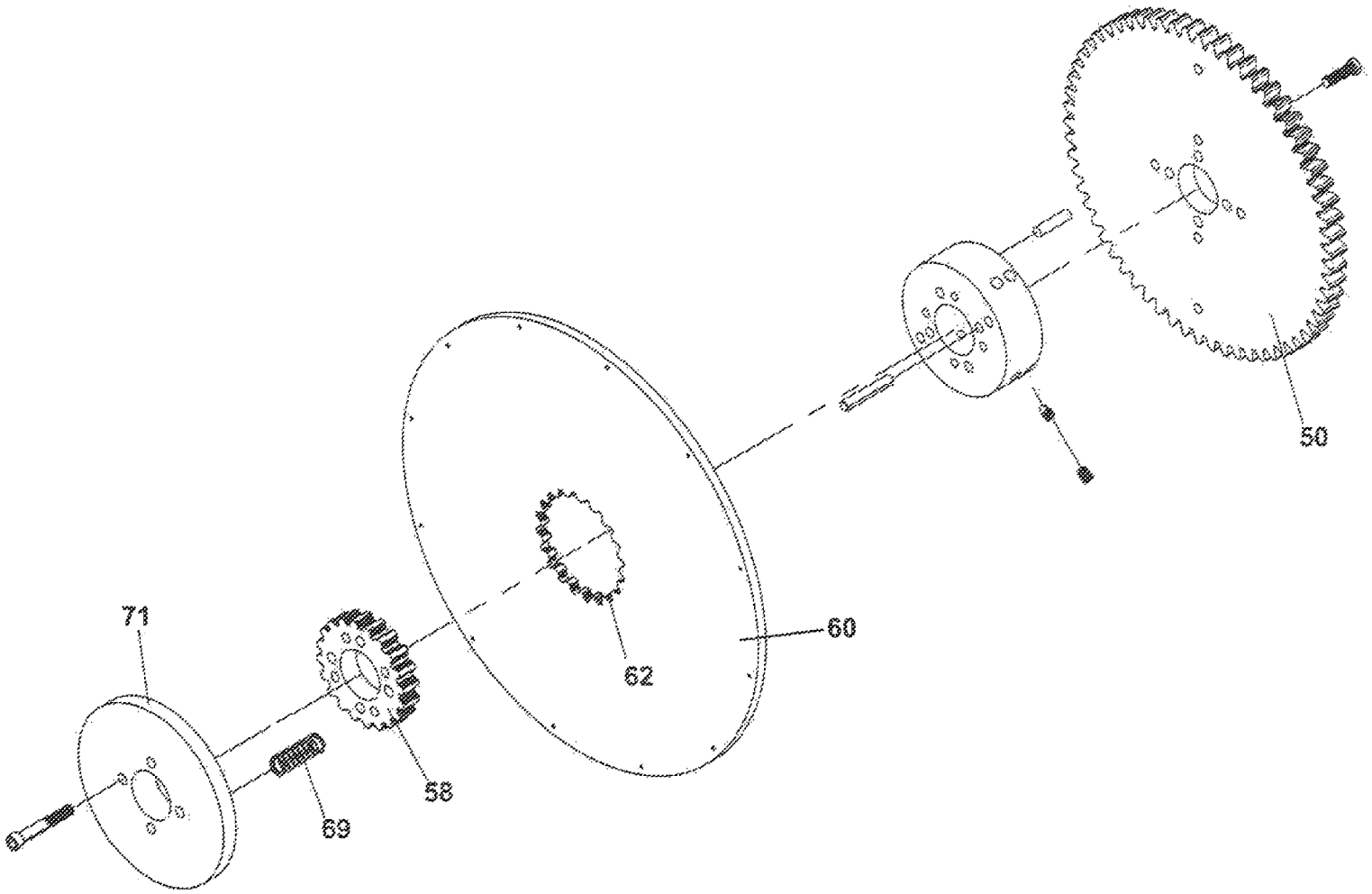
FIG. 11 is a perspective exploded view of a portion of the exemplary embodiment shown in FIG. 1.

For example, exemplary torque transfer assembly 46 includes one or more springs 69 between a collar 71 and clutch plate 60 (see FIGS. 4, 5, and 11). Spring(s) 69 provide a biasing force tending to promote engagement between recesses or apertures 68 of clutch plate 60 and clutch pins 66. However, when torque is supplied to hub 14 solely via secondary gear reduction assembly 42 and torque transfer assembly 46, if the load applied on line 12 and hub 14 is too great, springs 69 compress and permit clutch plate 60 to disengage clutch pins 66 (i.e., by moving to the right as shown in FIG. 4).

As shown in FIGS. 4-6, exemplary shift mechanism 44 is in a position resulting in main input shaft 20 being coupled to hub 14 via primary gear reduction assembly 40 rather than torque transfer assembly 46. In particular, as shown in FIG. 4, shift mechanism 44 includes a lever 70 coupled to a cam mechanism 72 configured to move main input shaft 20 longitudinally (i.e., left and right as shown in FIG. 4), such that in a first setting torque is transferred from main input shaft 20 to primary gear reduction assembly 40 via movement of a shift plate 74, and clutch plate 60 is disengaged from clutch pins 66 of clutch ring 64. In contrast, in a second setting, main input shaft 20 is moved longitudinally such that shift plate 74 disengages primary gear reduction assembly 40 from hub 14 and engages clutch plate 60 with clutch pins 66 of clutch ring 64 by moving main input shaft 20 longitudinally (i.e., to the left as shown in FIG. 4). For example, when lever 70 is rotated about the axis X to the position shown, spring 76 biases main input shaft 20 such that main input shaft 20 is engaged with hub 14 via primary gear reduction assembly 40. When lever 70 is rotated to another position, cam mechanism 72 overcomes the biasing force of spring 76, such that main input shaft 20 is in the second setting in which primary gear reduction assembly 40 is disengaged from hub 14, and clutch plate 60 is engaged with clutch pins 66 of clutch ring 64.

As shown in FIGS. 4 and 6, shift plate 74 is coupled to main input shaft 20 on a bearing 78, such that shift plate 74 moves longitudinally with main input shaft 20, but such that main input shaft 20 rotates within and independently of shift plate 74. Shift plate 74 is coupled to a first internal gear 80 of primary gear reduction assembly 40 via fasteners 82 and respective spacers 84. First internal gear 80 includes internal gear teeth 86 (see FIG. 13) for engaging other gears of primary gear reduction assembly 40 and external splines 88 configured to engage internal splines 90 of hub ring 92, which is coupled to the inner surface of hub 14 (see FIGS. 8-10B). Thus, longitudinal movement (i.e., to the left relative to the position shown in FIGS. 4 and 6) of shift plate 74 results in external splines 88 of first internal gear 80 no longer engaging internal splines 90 of hub ring 92. As a result, in such a setting, primary gear reduction assembly 40 no longer transfers torque from main input shat 20 to hub 14.

Referring to FIGS. 13-18B, exemplary primary gear reduction assembly 40 includes a carrier 94 coupled to main input shaft 20, for example, via splines or a collar 95 (see FIG. 14), such that torque from main input shaft 20 is transferred to carrier 94. Exemplary primary gear reduction assembly 40 also includes one or more carrier shafts 96 coupled to carrier 94 and spaced from main input shaft 20. Each of carrier shafts 96 has a spur gear pair 98 mounted thereon, such that spur gear pairs 98 rotate about respective carrier shafts 96. Each spur gear pair 98 includes a first spur gear 100 and a second spur gear 102 coupled to one another, such that they rotate together, for example, as first spur gear 100 rotates, second spur gear 102 rotates in the same direction, but not necessarily at the same rotational speed. With respect to the gears, the "spur" reference indicates that the gear teeth face radially outward.

According to some embodiments, first and second spur gears 100 and 102 of a spur gear pair 98 rotate at the same rotational speed. For example, first and second spur gears 100 and 102 of a spur gear pair may be fixedly coupled to one another in a face-to-face manner. According to some embodiments, first and second spur gears 100 and 102 coupled to one another such that they rotate at different rotational speeds. According to such embodiments, first spur gear 100 and second spur gear 102 are coupled to rotate independently of one another.

Figure 14:
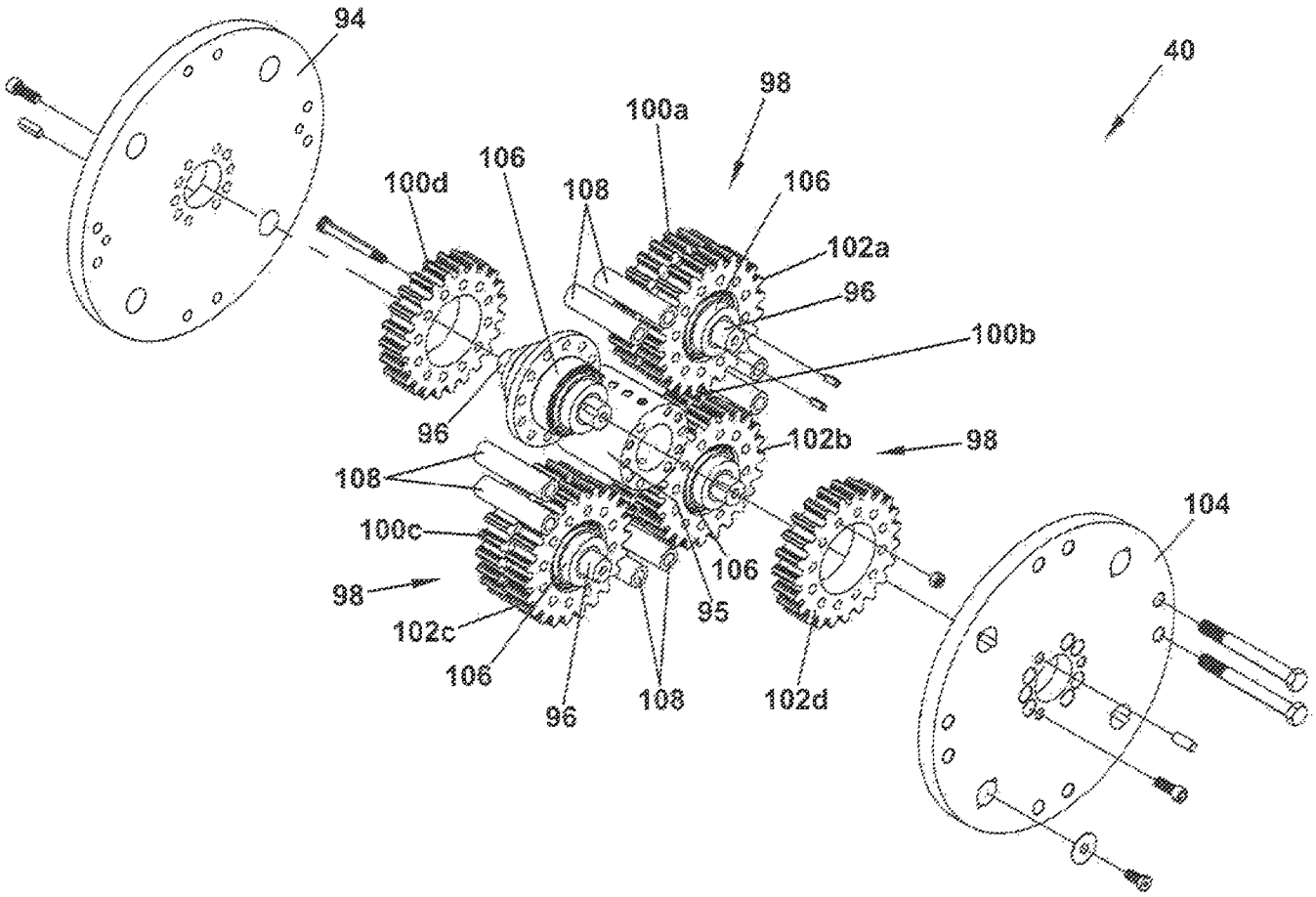
FIG. 14 is an exploded perspective view of a portion of the exemplary embodiment shown in FIG. 13.
Figure 15:
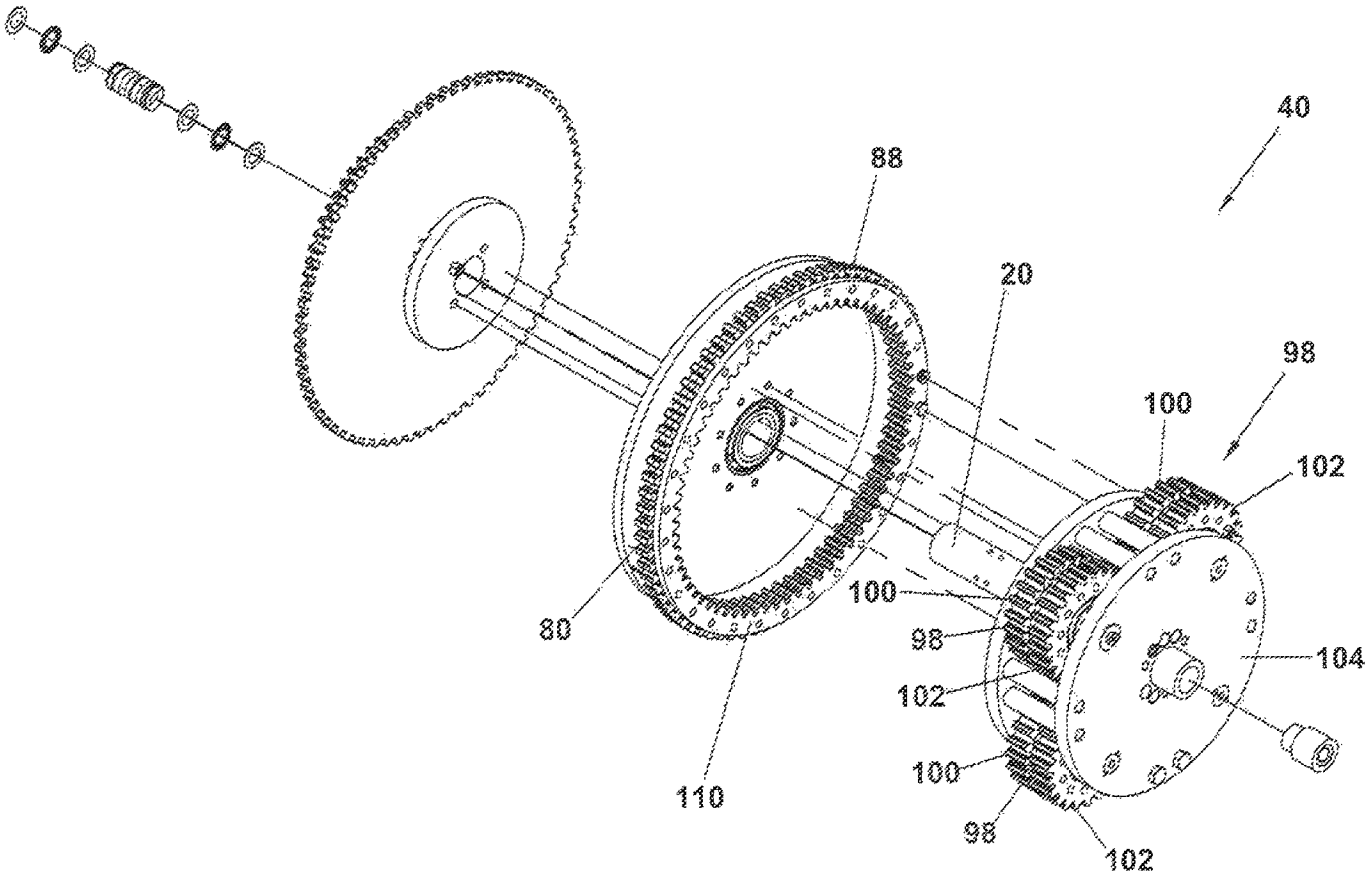
FIG. 15 is an exploded perspective view of the exemplary embodiment shown in FIG. 13.
Figure 16:
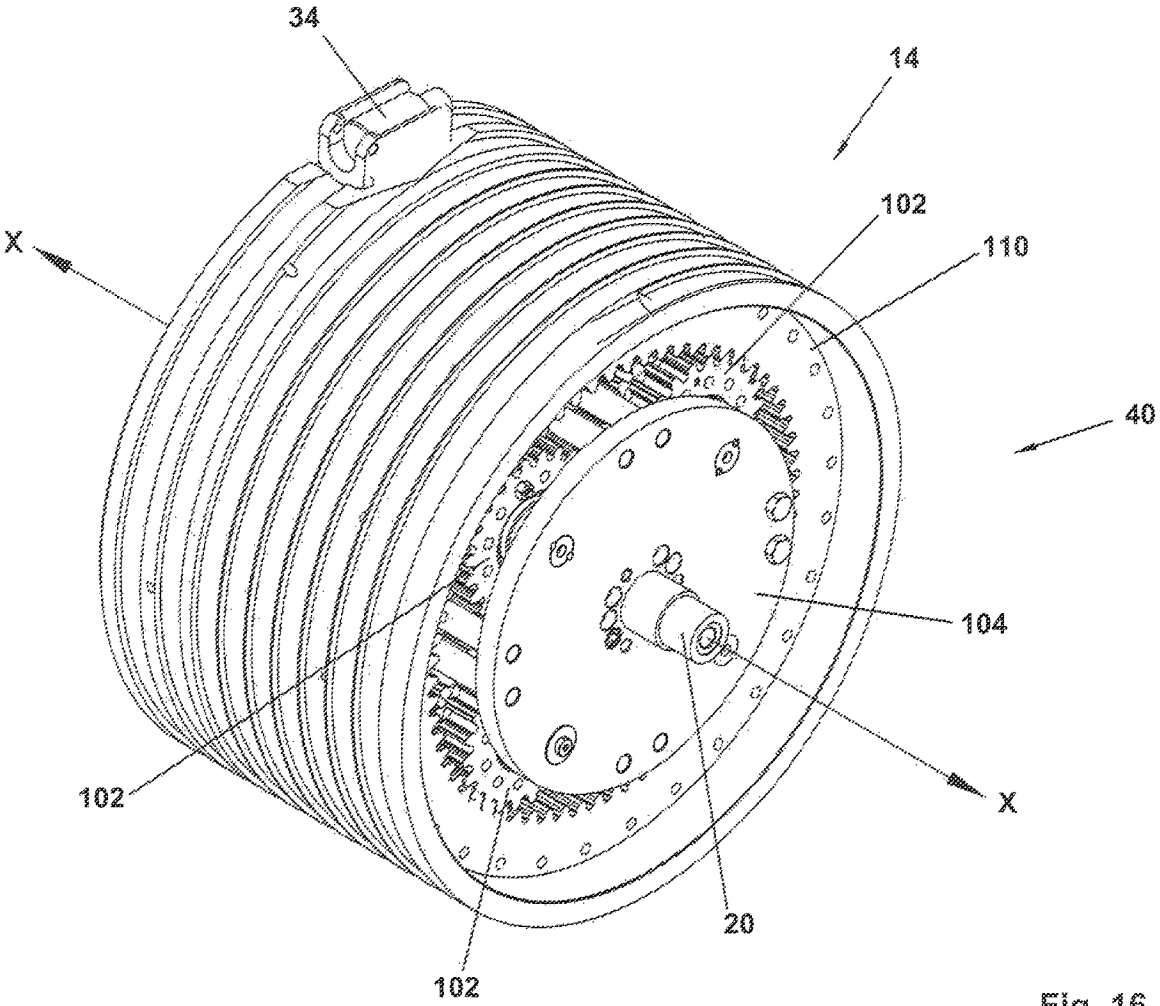
FIG. 16 is a perspective view of an exemplary embodiment of hub with an exemplary embodiment of primary gear reduction assembly.
Figure 17B:
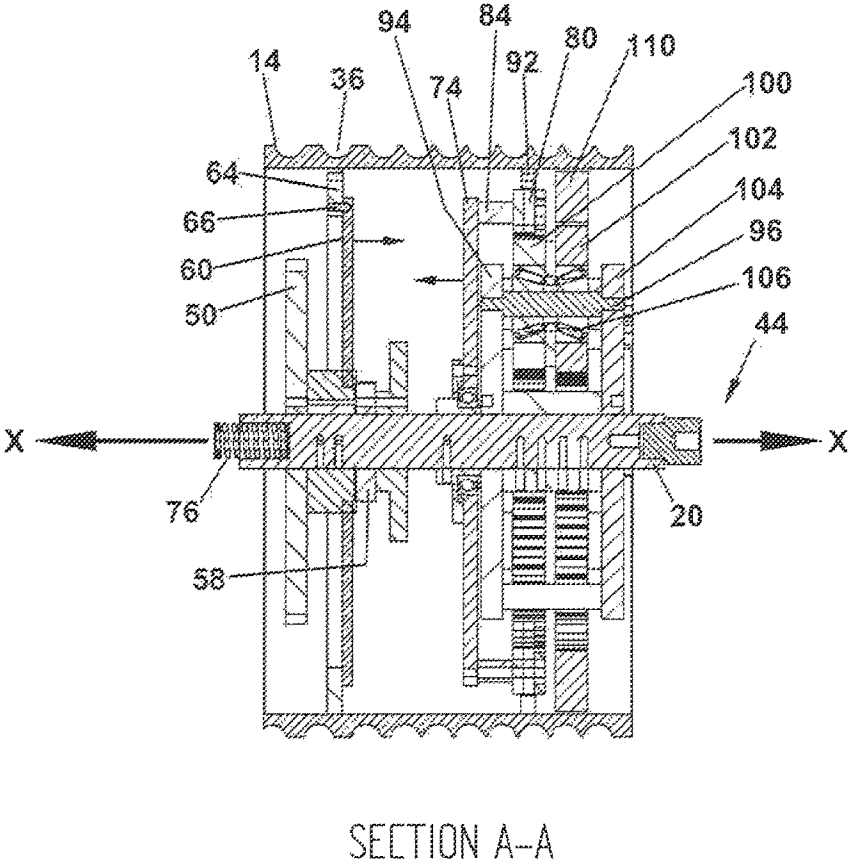
FIG. 17B is a side section view taken along line A-A of FIG. 17B.
Figure 17A:
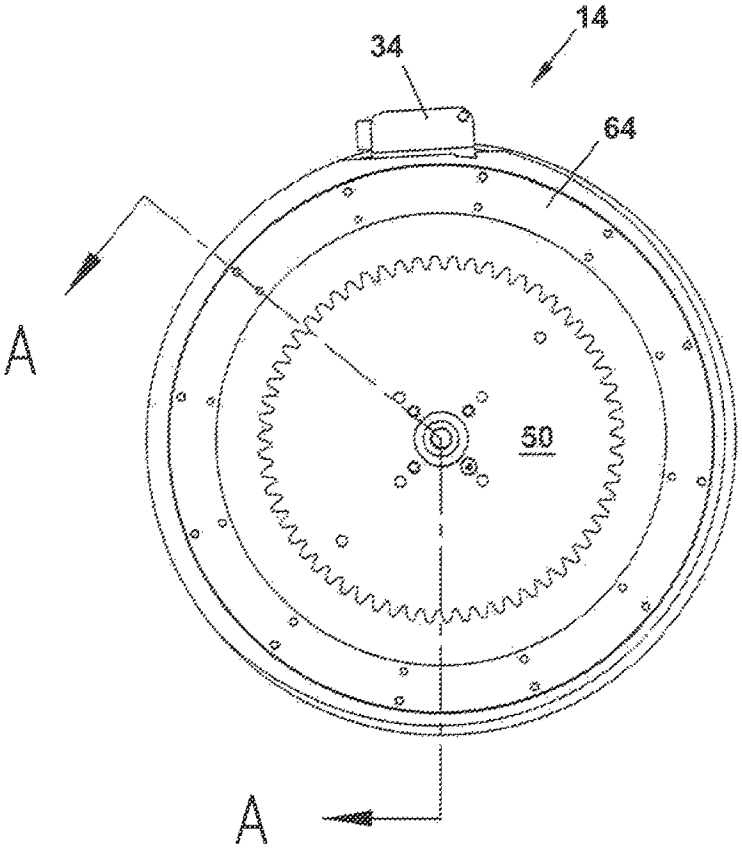
FIG. 17A is a side view of the exemplary hub shown in FIG. 16.

According to some embodiments, such as shown in FIG. 14, primary gear reduction assembly 40 further includes a carrier backing plate 104. Spur gear pairs 98 are received on carrier shafts 96 with bearings 106 in spur gear pairs 98 facilitating rotation of spur gear pairs 98 on carrier shafts 96. Spur gear pairs 98 are confined between carrier 94 and carrier backing plate 104. In the exemplary embodiment shown, spacers 108 are provided between carrier 94 and carrier backing plate 104 and provide sufficient clearance for spur gear pairs 98.

The exemplary embodiment shown in FIG. 14 includes four spur gear pairs 98, with a first spur gear pair 98*a* including a first spur gear 100*a* and a second spur gear 102*a*, a second spur gear pair 98*b* including a third spur gear 100*b* and a fourth spur gear 102*b*, a third spur gear pair 98*c* including a fifth spur gear 100*c* and a sixth spur gear pair 102*c*, and a fourth spur gear pair 98*d* including a seventh spur gear 100*d* and an eighth spur gear 102*d*. Other numbers of spur gear pairs are contemplated, including a single, double, or triple spur gear pairs, or more than four spur gear pairs.

Figure 13:
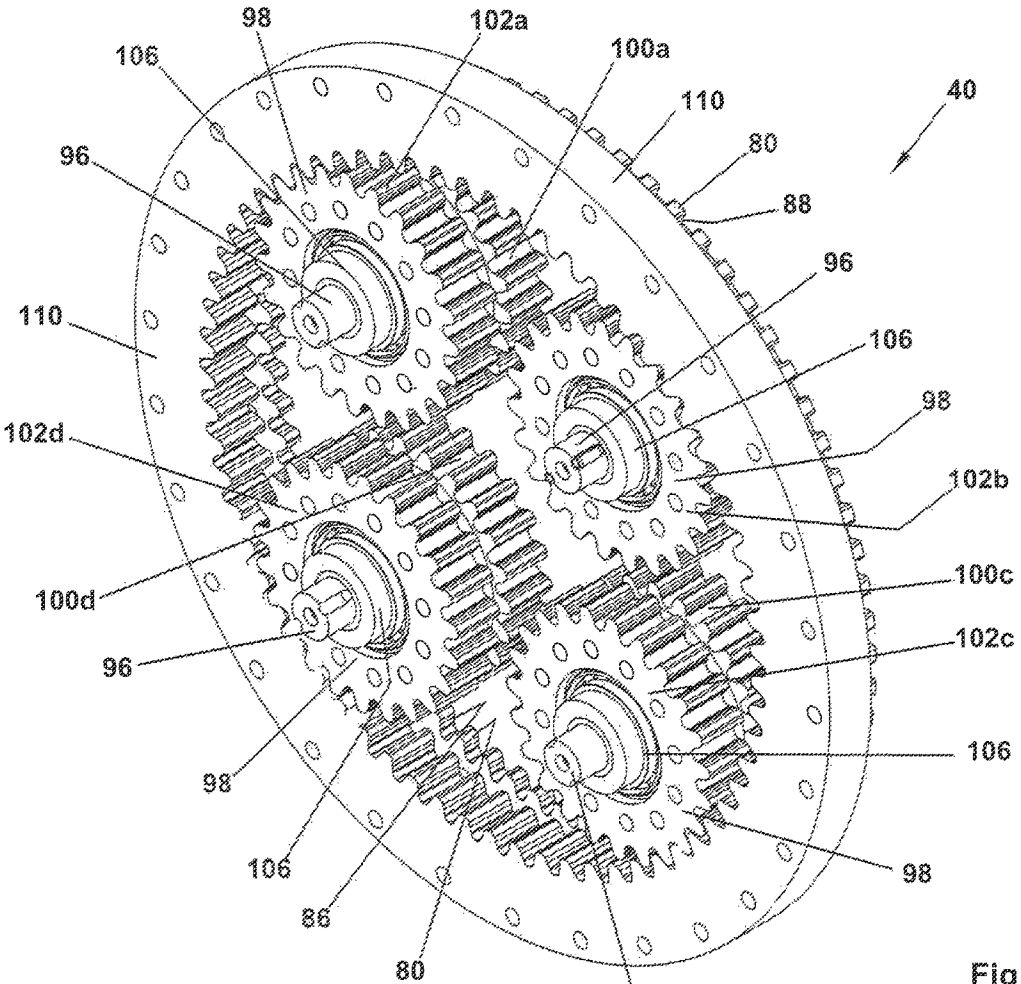
FIG. 13 is a perspective view of an exemplary embodiment of a primary gear reduction assembly.

As shown in FIG. 13, first spur gears 100*a*-100*d* engage first internal gear 80, and second spur gears 102*a*-102*d* engage a second internal gear 110 of primary gear reduction assembly 40, which in turn, in the exemplary embodiment shown, is coupled to an inner surface of side member 18*b*, such that second internal gear 110 does not rotate. With respect to the gears, the "internal" reference indicates that the teeth face radially inward.

As a result of this exemplary configuration, as carrier 94 is driven by main input shaft 20, carrier 94 rotates relative to second internal gear 110. Because spur gear pairs 98 are coupled to carrier 94, they revolve within first internal gear 80 and second internal gear 110. Because second spur gears 102*a*-102*d* of spur gear pairs 98*a*-98*d* are engaged with second internal gear, second spur gears 102*a*-102*d* are driven by second internal gear 110 as carrier 94 rotates. Second spur gears 102*a*-102*d* are coupled to first spur gears 100*a*-102*d*, and thus, second spur gears 102*a*-102*d* drive first spur gears 100*a*-100*d*. First spur gears 100*a*-100*d* are engaged with first internal gear 80, which is free to rotate about main input shaft 20 when driven by first spur gears 100*a*-100*d*. Thus, when lever 70 is in a setting in which shift plate 74 is in a longitudinal position that results in engagement between the respective splines of first internal gear 80 and hub ring 92, which is coupled to hub 14, hub 14 rotates. On the other hand, when lever 70 is in a setting in which shift plate 74 is not in a longitudinal position that results in engagement between the respective splines of first internal gear 80 and hub ring 92, hub 14 is not engaged with hub 14, and hub 14 rotates solely as a result of secondary gear reduction assembly 42, as explained previously herein.

In the exemplary embodiment shown, first spur gear 100 and second spur gear 102 of spur gear pair(s) 98 have the same number of teeth. However, it is not necessary that first and second spur gears 100 and 102 have the same number of teeth. Exemplary first internal gear 80 and second internal gear 110 have a different number of teeth. For example, the number of teeth of first and second internal gears 80 and 110 may differ by from one to five teeth (e.g., by one tooth).

According to some embodiments, first internal gear 80 has from one to five more teeth than second internal gear 110, such as, for example, one more tooth than second internal gear 110. In such embodiments, first internal gear 80 will rotate in the same direction as main input shaft 20. According to other embodiments, second internal gear 110 has from one to five more teeth than first internal gear 80, such as, for example, one more tooth than first internal gear 80. In such embodiments, first internal gear 80 (and hub 14) will rotate in the opposite direction from main input shaft 20.

Regardless of the number of teeth of first spur gear 100, second spur gear 102, first internal gear 80, and second internal gear 110, these gears may have any combination of diameters that results in first spur gear 100 and first internal gear 80 properly meshing, and second spur gear 102 and second internal gear 110 properly meshing. For example, it may be desirable for first spur gear 100 and first internal gear 80 to have respective diameters that are always tangent to one another as first spur gear 100 revolves within first internal gear 80. For example, it may be desirable for first spur gear 100 and first internal gear 80 to have respective pitch circle diameters that are always tangent to one another as first spur gear 100 revolves within first internal gear 80. Similarly, it may be desirable for second spur gear 102 and second internal gear 110 to have respective diameters that are always tangent to one another as second spur gear 102 revolves within second internal gear 110. For example, it may be desirable for second spur gear 102 and second internal gear 110 to have respective pitch circle diameters that are always tangent to one another as second spur gear 102 revolves within second internal gear 110.

According to some embodiments, first spur gear 100 and second spur gear 102 have the same number of teeth, but not the same diameter. For example, the pitch circle diameter of first spur gear 100 may be smaller than the pitch circle diameter of second spur gear 102. According to some embodiments, first spur gear 100 and second spur gear 102 have the same number of teeth, but the diameter of second spur gear 102 is smaller than the diameter of first spur gear 100 (e.g., the pitch circle diameter of second spur gear 102 is smaller than the pitch circle diameter of first spur gear 100). According to some embodiments, first spur gear 100 and second spur gear 102 have the same number of teeth and the same diameters (e.g., the same pitch circle diameters). According to some embodiments, first and second spur gears 100 and 102 have a different number of teeth and the same or different diameters (e.g., pitch circle diameters).

According to some embodiments, first internal gear 80 has from one to five teeth more than second internal gear 110, for example, one more tooth, but first internal gear 80 has a different diameter than second internal gear 110. For example, the pitch circle diameter of first internal gear 80 may be smaller than the pitch circle diameter of second internal gear 110. According to some embodiments, second internal gear 110 has from one to five teeth more than first internal gear 80, for example, one more tooth, but second internal gear 110 has a different diameter than first internal gear 80. For example, the pitch circle diameter of second internal gear 110 is smaller than the pitch circle diameter of first internal gear 80. According to some embodiments, the number of teeth of first internal gear 80 and second internal gear 110 differ by one to five teeth, for example, by one tooth, and first and second internal gears 80 and 110 have the same diameter (e.g., the same pitch circle diameter).

During operation of exemplary primary gear reduction assembly 40, main input shaft 20 is driven via hand operation, or one or more motors and/or engines, such that main input shaft 20 rotates. As main input shaft 20 rotates, if shift mechanism 44 is in the first setting, such that main input shalt 20 is coupled to hub 14 via primary gear reduction assembly 40, main input shaft 20 drives carrier 94, which in turn, results in carrier shafts 96 revolving about axis X. The teeth of second spur gear 102 of spur gear pair(s) 98 are engaged with the teeth of second internal gear 110. Thus, as second spur gear 102 revolves about axis X, second internal gear 110, which is coupled to side member 18*b*, such that it remains stationary, causes second spur gear 102 to rotate about its center. Second spur gear 102 is coupled to first spur gear 100 such that as second spur gear 102 rotates about its center, first spur gear 100 also rotates about its center, as it revolves about axis X of main input shaft 20. As first spur gear 100 rotates, its teeth, which are engaged with the teeth of first internal gear 80, drive first internal gear 80 so that it rotates about axis X of main input shaft 20. First internal gear 80 is coupled to hub 14 via hub ring 92, thereby driving hub 14 and either deploying or retracting line 12, depending on the direction of rotation of hub 14, the direction about which line 12 is wound on hub 14, and/or whether first internal gear 80 or second internal gear 110 has more teeth. If first internal gear 80 has more teeth than second internal gear 110, first internal gear 80 and hub 14 will rotate in the same direction as main input shaft 20. If second internal gear 110 has more teeth than first internal gear 80, first internal gear 80 and hub 14 will rotate in the opposite direction of main input shaft 20.

As explained above, main input shaft 20 drives second spur gear 102, which rotates by virtue of stationary second internal gear 110. Being coupled to first spur gear 100, second spur gear 102's rotation drives first spur gear 100, which, in turn, drives first internal gear 80 and hub 14. Thus, the difference between the speed of rotation of main input shaft 20 and the speed of rotation of hub 14 is related to the number of teeth on first and second internal gears 80 and 110 (i.e., multiplied by the reduction ratio due to secondary gear reduction assembly 42). In particular, if first internal gear 80 has more teeth than second internal gear 110, the ratio of the rotation speed of main input shaft 20 to the rotation speed of first internal gear 80 (i.e., the ratio of input to output of exemplary primary gear reduction assembly 40) is equal to the number of teeth of first internal gear 80, divided by the difference between the number of teeth of first internal gear 80 and the number of teeth of second internal gear 110.

For example, if first internal gear 80 has 200 teeth, and second internal gear 110 has 199 teeth, the difference is one, and the ratio is 200:1, or the number of teeth of first internal gear 80, 200, divided by the difference, one. If, however, second internal gear 110 has more teeth than first internal gear 80, the ratio of the rotation speed of main input shaft 20 to the rotation speed of first internal gear 80 (i.e., the ratio of input to output of the exemplary primary gear reduction assembly 40) is equal to the number of teeth of second internal gear 110, divided by the difference between the number of teeth of second internal gear 110 and the number of teeth of first internal gear 80. Because first internal gear 80 will rotate in the opposite direction from the direction of rotation of main input shaft 20 when second internal gear 110 has more teeth than first internal gear 80, a minus sign may be placed in front of the ratio. Thus, the ratio of the rotation speed of main input shaft 20 to a rotation speed of first internal gear 80 is equal to the greater of the number of teeth of first internal gear 80 and the number of teeth of second internal gear 110, divided by the difference between the number of teeth of first internal gear 80 and the number of teeth of second internal gear 110 (i.e., if the number of teeth of first spur gear 100 equals the number of teeth of second spur gear 102).

Exemplary secondary gear reduction assembly 42 has a ratio of the rotation speed of crank 27 to a rotation speed of main input shaft 20 equal to the number of teeth of driven gear 50, which is coupled to main input shaft 20, divided by the number of teeth of drive gear 48, which is coupled to crank 27. Thus, if, for example, drive gear 48 has 10 teeth, and driven gear has 60 teeth, the ratio of input to output of exemplary secondary gear reduction assembly 42 is 60 divided by 10, or 6:1. For such an example, if the input-to-output ratio of primary gear reduction assembly 40 is 200:1, and the input-to-output ratio of secondary gear reduction assembly is 6:1, the total input-to-output ratio of gear reduction assembly 38 is 1,200:1 (the two ratios multiplied together) when shift mechanism 44 is in the first setting, in which both primary gear reduction assembly 40 and secondary gear reduction assembly 42 are engaged. On the other hand, when shift mechanism 44 is in the second setting, in which only secondary gear reduction assembly couples crank 27 to hub 14, the gear reduction ration of input-to-output is 6:1 (i.e., the ratio of secondary gear reduction assembly 42).

As mentioned previously, for some embodiments, exemplary first spur gear 100 and second spur gear 102 have the same number of teeth, but different diameters, and first internal gear 80 and second internal gear 110 have a different number of teeth and different diameters. In such embodiments, second spur gear 102 may have a larger pitch circle diameter than the pitch circle diameter of first spur gear 100 in order to have a diameter large enough to facilitate engagement between its teeth and the teeth of second internal gear 110, which may have a pitch circle diameter larger than the pitch circle diameter of first internal gear 80.

Figure 18B:
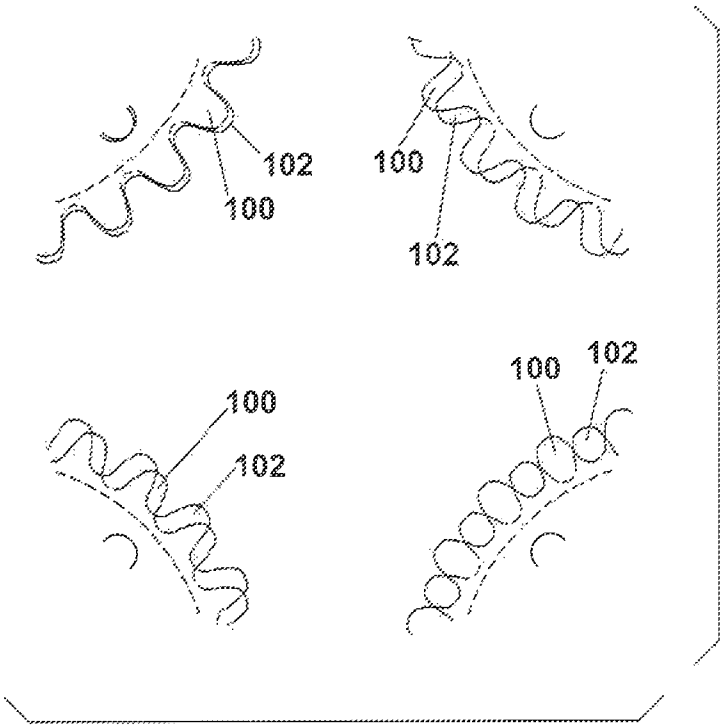
FIG. 18B is a detail view taken from FIG. 18A.
Figure 18A:
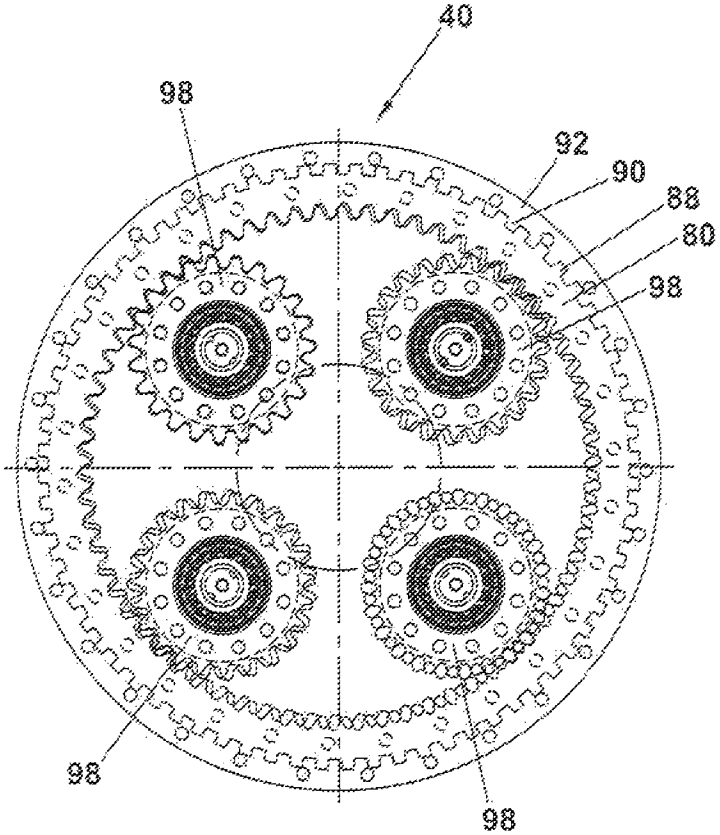
FIG. 18A is a side view of the exemplary embodiment shown in FIG. 13.

As shown in FIGS. 18A and 18B, for embodiments in which first spur gear 100 and second spur 102 have the same number of teeth but slightly different diameters, the teeth of respective first and second spur gears 100 and 102 are not necessarily aligned. For example, as shown in FIGS. 18A and 18B, although the number of teeth is the same, the teeth are not aligned due to the difference in diameters of the first and second spur gears 100 and 102.

According to some embodiments, first and second spur gears 100 and 102 may be coupled to one another in a manner that permits them to rotate at different speeds. For example, rather than being rigidly fixed to one another, first and second spur gears 100 and 102 may be coupled solely via a drive pin.

Exemplary gear reduction assembly 38, when used with, for example, exemplary winch 10, may provide a relatively dramatic gear reduction in a relatively compact manner. Further, exemplary gear reduction assembly 38, when used with exemplary winch 10, may facilitate use of a hub 14 or drum having a relatively larger diameter, which may be driven with relatively less effort via hand and/or relatively less power via a motor and/or engine. According to some embodiments of winch 10, an additional gear train (not shown) may be used in conjunction with exemplary gear reduction assembly 38. For example, such a gear train could be coupled to main input shaft 20 to alter (e.g., increase or decrease) the input-to-output ratio provided by gear reduction assembly 38.

According to some embodiments, exemplary gear reduction assembly 38 may be self-locking, for example, such that although hub 14 and first internal gear 80 may be driven by rotating main input shaft 20, it may not be possible rotate hub 14 and first internal gear 80 by applying torque to hub 14 or first internal gear 80. For example, if exemplary gear reduction assembly 38 is used with exemplary winch 10, it may not be possible to pull against line 12 on hub 14 and move hub 14 and first internal gear 80. This may be desirable because it may preclude the need to provide a separate break mechanism or locking mechanism for winch 10.

According to some embodiments, exemplary winch 10 may be able to facilitate a controlled release of a large load, for example, at a controlled rate. In other words, in contrast to some conventional winches that rely on a locking ratchet gear to hold a load, exemplary winch 10 includes a gear reduction assembly that permits a controlled release of a large load, thereby providing safer operation.

According to the exemplary embodiments disclosed herein, the output of exemplary gear reduction assembly 38 is concentric with main input shaft 20. In other words, exemplary main input shaft 20 and exemplary hub 14 lie on and rotate about the same longitudinal axis (i.e., longitudinal axis X). By virtue of this exemplary arrangement, hub 14 does not wobble with respect to the remainder of gear reduction assembly 38. This may be desirable because it avoids the possibility of providing a compensation mechanism to offset wobble of the hub 14 or output of the gear reduction assembly.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A winch for at least one of deploying line and retracting line, the winch comprising:
- a base member;
- two side members coupled to the base member;
- a hub about which line may be wound; and
- a primary gear reduction assembly comprising:
  - a main input shaft;
  - a carrier coupled to the main input shaft;
  - at least one carrier shaft coupled to the carrier and spaced from the main input shaft;
  - at least one spur gear pair comprising:
    - a first spur gear coupled to the carrier shaft, and
    - a second spur gear,
    - wherein the first spur gear and the second spur gear are coupled to one another such that the first and second spur gears rotate together, and
    - wherein the first spur gear and the second spur gear have a different number of teeth;
  - a first internal gear engaged with the first spur gear;
  - a second internal gear engaged with the second spur gear,
  - wherein the first internal gear and the hub are coupled to one another,
  - wherein the second internal gear and one of the side members are coupled to one another, and
  - wherein rotation of the main input shaft results in rotation of the hub; and a secondary gear reduction assembly comprising:
    - a secondary input shaft;
    - a drive gear coupled to the secondary input shaft; and
    - a driven gear engaged with the drive gear, the driven gear being coupled to the main input shaft,
    - wherein the drive gear has fewer teeth than the driven gear, and
    - wherein the secondary gear reduction assembly is coupled to the main input shaft.

2. The winch of claim 1, wherein the first spur gear and the second spur gear are coupled to one another such that the first spur gear and the second spur gear rotate at the same speed.

3. The winch of claim 1, wherein the winch comprises an anchor configured to couple the winch to a support.

4. The winch of claim 1, wherein the winch is self-locking such that rotation of the hub by applying torque to a radially exterior portion of the hub is substantially inhibited.

5. The winch of claim 1, wherein the primary and secondary gear reduction assemblies are configured such that the secondary gear reduction assembly is selectively coupled to the hub either via the primary gear reduction assembly or via a torque transfer assembly.

6. The winch of claim 5, further comprising a shift linkage configured to selectively couple the secondary gear reduction assembly to the hub either via the primary gear reduction assembly or via the torque transfer assembly.

7. The winch of claim 5, wherein the torque transfer assembly comprises a clutch assembly.

8. The winch of claim 7, wherein the clutch assembly comprises a clutch plate coupled to the main input shaft, and a clutch ring coupled to the hub.

9. The winch of claim 8, wherein the clutch plate and the clutch ring are configured to engage one another via clutch pins.

10. A winch for at least one of deploying line and retracting line, the winch comprising:
- a base member;
- two side members coupled to the base member;
- a hub about which line may be wound; and
- a primary gear reduction assembly comprising:
  - a main input shaft;
  - a carrier coupled to the main input shaft;
  - at least one carrier shaft coupled to the carrier and spaced from the main input shaft;
  - at least one spur gear pair comprising:
    - a first spur gear coupled to the carrier shaft, and
    - a second spur gear,
    - wherein the first spur gear and the second spur gear are coupled to one another such that the first and second spur gears rotate together, and
    - wherein the first spur gear and the second spur gear have a different number of teeth;

a first internal gear engaged with the first spur gear; and
a second internal gear engaged with the second spur gear,
wherein the hub is associated with the first internal gear, and
wherein the first internal gear has a first number of teeth and the second internal gear has a second number of teeth, and the first number of teeth differs from the second number of teeth by from one to five teeth; and
a secondary gear reduction assembly comprising:
a secondary input shaft;
a drive gear coupled to the secondary input shaft; and
a driven gear engaged with the drive gear, the driven gear being coupled to the main input shaft,
wherein the drive gear has fewer teeth than the driven gear, and
wherein the secondary gear reduction assembly is coupled to the main input shaft.

11. The winch of claim 10, wherein the first spur gear and the second spur gear are coupled to one another such that the first spur gear and the second spur gear rotate at the same speed.

12. The winch of claim 10, wherein the winch comprises an anchor configured to couple the winch to a support.

13. The winch of claim 10, wherein the winch is self-locking such that rotation of the hub by applying torque to a radially exterior portion of the hub is substantially inhibited.

14. The winch of claim 10, wherein the primary and secondary gear reduction assemblies are configured such that the secondary gear reduction assembly is selectively coupled to the hub either via the primary gear reduction assembly or via a torque transfer assembly.

15. The winch of claim 14, further comprising a shift linkage configured to selectively couple the secondary gear reduction assembly to the hub either via the primary gear reduction assembly or via the torque transfer assembly.

16. The winch of claim 14, wherein the torque transfer assembly comprises a clutch assembly.

17. The winch of claim 16, wherein the clutch assembly comprises a clutch plate coupled to the main input shaft, and a clutch ring coupled to the hub.

18. The winch of claim 17, wherein the clutch plate and the clutch ring are configured to engage one another via clutch pins.

19. A winch for at least one of deploying line and retracting line, the winch comprising:
a base member;
two side members coupled to the base member;
a hub about which line may be wound; and
a primary gear reduction assembly comprising:
a main input shaft;
a carrier coupled to the main input shaft;
at least one carrier shaft coupled to the carrier and spaced from the main input shaft;
at least one spur gear pair comprising:
a first spur gear coupled to the carrier shaft, and
a second spur gear,
wherein the first spur gear and the second spur gear are coupled to one another such that the first and second spur gears rotate together, and
wherein the first spur gear and the second spur gear have a different number of teeth;
a first internal gear engaged with the first spur gear; and
a second internal gear engaged with the second spur gear,
wherein the hub is associated with the first internal gear,
wherein the first internal gear has a first number of teeth and the second internal gear has a second number of teeth, and the first number of teeth differs from the second number of teeth by from one to five teeth, and
wherein the first internal gear has a first diameter and the second internal gear has a second diameter, and the first diameter of the first internal gear differs from the second diameter of the second internal gear; and
a secondary gear reduction assembly comprising:
a secondary input shaft;
a drive gear coupled to the secondary input shaft; and
a driven gear engaged with the drive gear, the driven gear being coupled to the main input shaft,
wherein the drive gear has fewer teeth than the driven gear, and
wherein the secondary gear reduction assembly is coupled to the main input shaft.

20. The winch of claim 19, wherein the second diameter of the second internal gear is greater than the first diameter of the first internal gear.

* * * * *